US009368944B2

(12) United States Patent
Sakakura

(10) Patent No.: US 9,368,944 B2
(45) Date of Patent: Jun. 14, 2016

(54) SPARK PLUG

(71) Applicant: NGK SPARK PLUG CO., LTD., Nagoya-shi, Aichi (JP)

(72) Inventor: Yasushi Sakakura, Ichinomiya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 0 days.

(21) Appl. No.: 14/787,508

(22) PCT Filed: May 21, 2014

(86) PCT No.: PCT/JP2014/063470
§ 371 (c)(1),
(2) Date: Oct. 28, 2015

(87) PCT Pub. No.: WO2014/189079
PCT Pub. Date: Nov. 27, 2014

(65) Prior Publication Data

US 2016/0087411 A1 Mar. 24, 2016

(30) Foreign Application Priority Data

May 23, 2013 (JP) ..... 2013-109156

(51) Int. Cl.
*H01T 13/39* (2006.01)
*H01T 13/32* (2006.01)
*H01T 13/46* (2006.01)

(52) U.S. Cl.
CPC ..... *H01T 13/39* (2013.01); *H01T 13/32* (2013.01); *H01T 13/467* (2013.01)

(58) Field of Classification Search
USPC ..... 123/169 EL
See application file for complete search history.

(56) References Cited

U.S. PATENT DOCUMENTS

| | | | | |
|---|---|---|---|---|
| 5,693,999 | A | 12/1997 | Osamura et al. | 313/141 |
| 2007/0228916 | A1 * | 10/2007 | Kunitomo | H01T 13/32 313/143 |
| 2010/0133976 | A1 * | 6/2010 | Siegel | H01T 13/20 313/141 |
| 2012/0299459 | A1 * | 11/2012 | Sakakura | H01T 13/32 313/141 |

FOREIGN PATENT DOCUMENTS

| | | |
|---|---|---|
| JP | 8-315955 | 11/1996 |
| JP | 2003-257585 A | 9/2003 |

OTHER PUBLICATIONS

International Search Report issued in corresponding International Application No. PCT/JP2014/063470, dated Jun. 24, 2014.

* cited by examiner

*Primary Examiner* — Ashok Patel
(74) *Attorney, Agent, or Firm* — Kunser & Jaffe

(57) ABSTRACT

A spark plug including a center electrode, an insulator, a metal shell, a first ground electrode, and a second ground electrode. The center electrode extends in an axial direction. The insulator has an axial hole extending in the axial direction. The center electrode is to be inserted into the axial hole. The metal shell is arranged at an outer periphery of the insulator. The first ground electrode has electrical continuity with the metal shell, and forms a first gap with a front end surface of the center electrode. The second ground electrode has electrical continuity with the metal shell, is sealed to metal shell, extends from the metal shell to a position facing a side surface of the center electrode, and forms an annular second gap between the side surface of the center electrode and an inner peripheral surface of the second ground electrode.

7 Claims, 10 Drawing Sheets

SPARK PLUG

RELATED APPLICATIONS

This application is a National Stage of International Application No. PCT/JP14/63470 filed May 21, 2014, which claims the benefit of Japanese Patent Application No. 2013-109156, filed May 23, 2013.

FIELD OF THE INVENTION

The present invention relates to a spark plug.

BACKGROUND OF THE INVENTION

Conventionally, a spark plug is used in an internal combustion engine. The configuration of the spark plug generally includes a center electrode and a ground electrode. The center electrode and the ground electrode form the gap for causing a spark.

Improving the durability of the spark plug suppresses various malfunctions thereby reducing maintenance of the internal combustion engine. In this respect, the durability of the spark plug can be affected by various factors. For example, during the operation of the internal combustion engine, an increase in temperature of the electrode might cause electrode wear. The advance of the electrode wear might not allow the spark plug to provide the intended performance (for example, causes an ignition failure).

An advantage of the present invention is a new technique that improves the durability of the spark plug.

SUMMARY OF THE INVENTION

The present invention has been conceived to solve the above-mentioned problems, and can be realized as the following application examples.

Application Example 1

In accordance with a first aspect of the present invention, there is provided a spark plug having a center electrode, an insulator, a metal shell, a first ground electrode, and a second ground electrode. The center electrode extends in an axial direction. The insulator has an axial hole extending in the axial direction. The center electrode is to be inserted into the axial hole. The metal shell is arranged at an outer periphery of the insulator. The first ground electrode has electrical continuity with the metal shell. The first ground electrode forms a first gap with a front end surface of the center electrode. The second ground electrode has electrical continuity with the metal shell. The second ground electrode is sealed to metal shell. The second ground electrode extends from the metal shell to a position facing a side surface of the center electrode. The second ground electrode forms an annular second gap between the side surface of the center electrode and an inner peripheral surface of the second ground electrode. A proportion of a size of the first gap to a size of the second gap is equal to or more than 0.80 and equal to or less than 1.25.

With this configuration, both the first ground electrode and the second ground electrode are used for discharge. This allows improving the durability of the spark plug.

Application Example 2

In accordance with a second aspect of the present invention, there is provided a spark plug according to the application example 1, wherein the first ground electrode includes a first nickel portion that is a portion formed by nickel or a nickel alloy. The first nickel portion has a nickel content of 90 weight % or more. The second ground electrode includes a second nickel portion that is a portion formed by nickel or a nickel alloy. The second nickel portion has a nickel content of 90 weight % or more.

With this configuration, respective thermal conductivities of the first ground electrode and the second ground electrode are improved. This allows suppressing the wear of the first ground electrode and the second ground electrode due to high temperature.

Application Example 3

In accordance with a third aspect of the present invention, there is provide a spark plug according to the application example 1 or 2, wherein at least one of the first ground electrode and the second ground electrode includes: a surface layer that forms a surface thereof; and a core portion that is formed inside of the surface layer and has a larger thermal conductivity than a thermal conductivity of the surface layer.

With this configuration, the thermal conductivity is improved by the core portion. This allows suppressing the wear of the ground electrode due to high temperature.

Application Example 4

In accordance with a fourth aspect of the present invention, there is provided a spark plug according to the application example 3, wherein the first ground electrode is sealed to the second ground electrode.

With this configuration, the temperature of the first ground electrode is likely to increase compared with the case where the first ground electrode is sealed directly to the metal shell. However, the thermal conductivity is improved by the core portion. This allows suppressing the wear of the ground electrode due to high temperature.

Application Example 5

In accordance with a fifth aspect of the present invention, there is provided a spark plug according to any one of the application examples 1 to 4, wherein a shortest distance between a surface of the second ground electrode and a surface of the insulator is twice or more as large as a maximum value between the size of the first gap and the size of the second gap.

This configuration allows suppressing occurrence of discharge along the surface of the insulator even in the case where the first gap and the second gap are large due to the wear of the ground electrode. Accordingly, the durability of the spark plug can be improved.

Application Example 6

In accordance with a sixth aspect of the present invention, there is provided a spark plug according to any one of the application examples 1 to 5, wherein the first ground electrode includes a first noble metal portion that is formed by a noble metal or a noble metal alloy in a position forming the first gap. The second ground electrode includes a second noble metal portion that is formed by a noble metal or a noble metal alloy in a position forming the second gap. In the center electrode, at least a first portion and a second portion are formed by a noble metal or a noble metal alloy. The first portion forms the first gap with the first noble metal portion. The second portion forms the second gap with the second noble metal portion.

This configuration allows suppressing the wear of each of the center electrode, the first ground electrode, and the second ground electrode.

Application Example 7

In accordance with a seventh aspect of the present invention, there is provided a spark plug according to the application example 6, wherein the noble metal or the noble metal alloy is iridium or an iridium alloy.

This configuration allows appropriately suppressing the wear of each of the center electrode, the first ground electrode, and the second ground electrode.

Here, the present invention can be realized by various forms, for example, can be realized in a form of a spark plug, an internal combustion engine on which the spark plug is mounted or similar form.

DETAILED DESCRIPTION OF THE PREFERRED EMBODIMENTS

A. First Embodiment

A1. Configuration of Spark Plug

Figure 1:
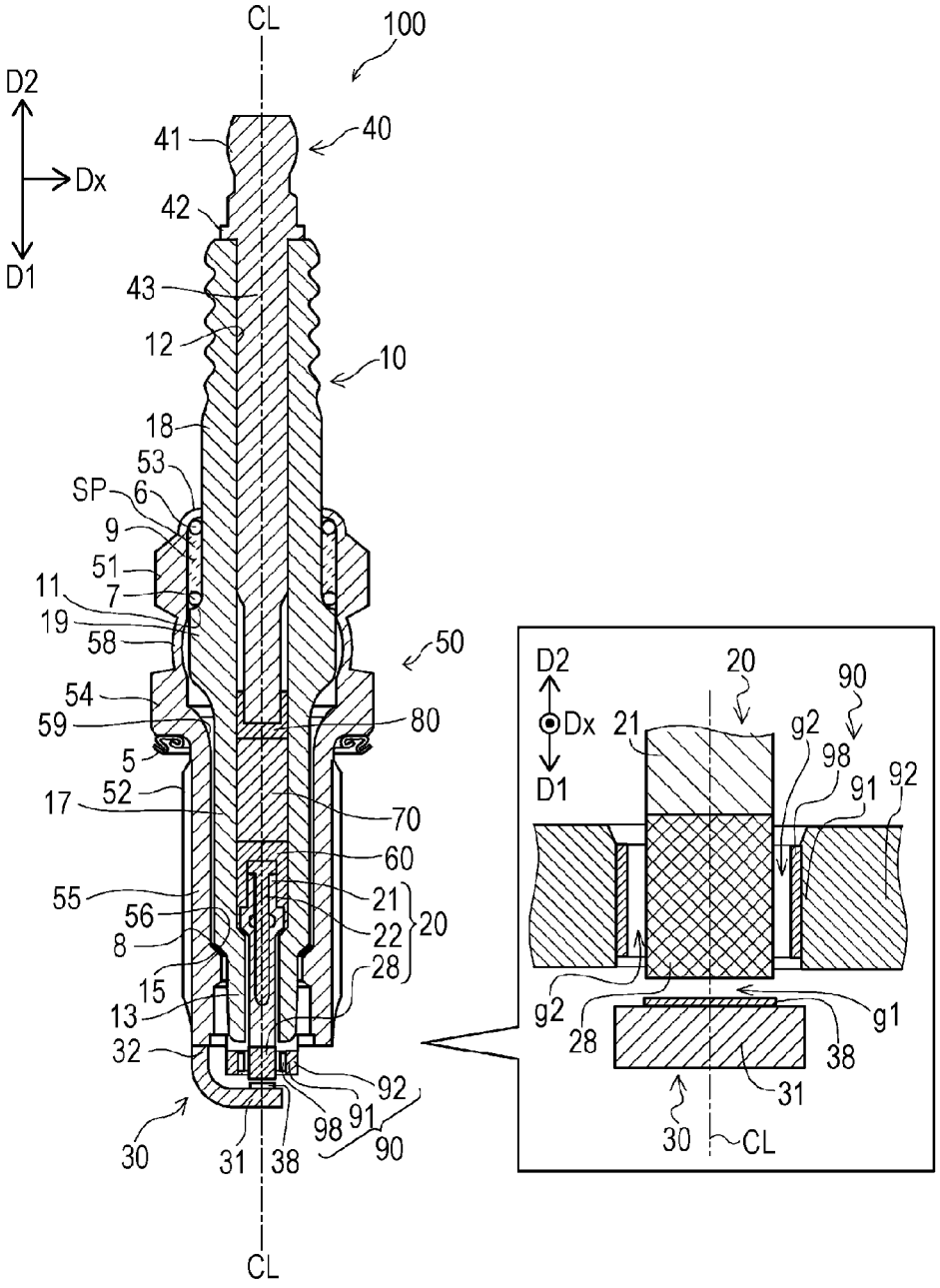
FIG. 1 is a sectional view of a spark plug 100 of a first embodiment.

FIG. 1 is a sectional view of a spark plug 100 of a first embodiment. The line CL shown in the drawing denotes the central axis of the spark plug 100. Hereinafter, the central axis CL is also referred to as an "axial line CL" and the direction parallel to the central axis CL is also referred to as an "axial direction." The radial direction of the circle around the central axis CL is also referred to simply as a "radial direction" and the direction of the circumference of the circle around the central axis CL is also referred to as a "circumferential direction." In the drawings, the first direction D1 and the second direction D2 are parallel to the axial line CL. The second direction D2 is the direction opposite to the first direction D1. As describe later, a center electrode 20, a first ground electrode 30, and a second ground electrode 90, which form a spark gap (also referred to simply as a "gap"), form the end portion on the first direction D1 side of the spark plug 100. Hereinafter, the first direction D1 side is also referred to as a "front end side," and the second direction D2 side is also referred to as a "rear end side."

The spark plug 100 includes a ceramic insulator 10, the center electrode 20, the first ground electrode 30, the second ground electrode 90, a terminal metal fitting 40, a metal shell 50, a conductive seal 60, a resistor element 70, a conductive seal 80, a front-end-side packing 8, a talc 9 as one example of a buffer, a first rear-end-side packing 6, and a second rear-end-side packing 7. The right side in the drawing shows an expansion (i.e., enlarged) figure of the cross section of the portions forming gaps g1 and g2 described later in the center electrode 20, the first ground electrode 30, and the second ground electrode 90 viewed from another direction.

The ceramic insulator 10 is an approximately cylindrically-shaped member with a through hole 12 (an axial hole). The through hole 12 extends along the central axis CL so as to pass through the ceramic insulator 10. The ceramic insulator 10 is formed by sintering alumina (another insulating material can also be adopted). The ceramic insulator 10 includes a nose portion 13, a first outer-diameter contracted portion 15, a front-end-side trunk portion 17, a flange portion 19, a second outer-diameter contracted portion 11, and a rear-end-side trunk portion 18 that are arranged from the front end side toward the rear end side in this order.

The flange portion 19 is the portion positioned approximately in the center of the axial direction of the ceramic insulator 10, and is the maximum outer diameter portion of the ceramic insulator 10. On the front end side of the flange portion 19, the front-end-side trunk portion 17 is disposed. On the front end side of the front-end-side trunk portion 17, the first outer-diameter contracted portion 15 is disposed. The outer diameter of the first outer-diameter contracted portion 15 gradually decreases from the rear end side toward the front end side. On the front end side of the first outer-diameter contracted portion 15, the nose portion 13 is disposed. In the state where the spark plug 100 is installed on an internal combustion engine (not shown), the nose portion 13 is exposed to a combustion chamber.

On the rear end side of the flange portion 19, the second outer-diameter contracted portion 11 is disposed. The outer diameter of the second outer-diameter contracted portion 11 gradually decreases from the front end side toward the rear end side. On the rear end side of the second outer-diameter contracted portion 11, the rear-end-side trunk portion 18 is disposed.

Into the front end side of the through hole 12 of the ceramic insulator 10, the center electrode 20 is inserted. The center electrode 20 is a rod-shaped member that extends along the central axis CL. The center electrode 20 includes an electrode base material 21, a core material 22, and a column-shaped tip 28. The core material 22 is buried inside of the electrode base material 21. The tip 28 is sealed to the front end side of the electrode base material 21, and has the center on the central axis CL. The rear end portion of the core material 22 is exposed from the electrode base material 21 so as to form the rear end portion of the center electrode 20. The other portion of the core material 22 is coated with the electrode base material 21. However, the entire core material 22 may be covered with the electrode base material 21. The electrode base material 21 is formed by using, for example, an alloy containing nickel. The core material 22 is formed of, for example, an alloy containing copper. The tip 28 is formed of an alloy containing iridium (however, another conductive material (for example, a metallic material) can also be adopted). The tip 28 is sealed to the electrode base material 21 by, for example, laser beam welding. A part of the rear end side of the center electrode 20 is arranged within the through hole 12 of the ceramic insulator 10. A part of the front end side of the center electrode 20 is exposed on the front end side of the ceramic insulator 10.

Into the rear end side of the through hole 12 of the ceramic insulator 10, the terminal metal fitting 40 is inserted. The terminal metal fitting 40 is a rod-shaped member that extends along the central axis CL. The terminal metal fitting 40 is formed using low-carbon steel (however, another conductive material (for example, a metallic material) can also be adopted). The terminal metal fitting 40 includes a flange portion 42, a plug cap installation portion 41, and a nose portion 43. The plug cap installation portion 41 forms the portion on the rear end side with respect to the flange portion 42. The nose portion 43 forms the portion on the front end side with respect to the flange portion 42. The plug cap installation portion 41 is exposed on the rear end side of the ceramic insulator 10. The nose portion 43 is inserted into the through hole 12 of the ceramic insulator 10.

In the through hole 12 of the ceramic insulator 10, the resistor element 70 is arranged between the terminal metal fitting 40 and the center electrode 20. The resistor element 70 reduces the radio wave noise during the occurrence of the spark. The resistor element 70 is formed by the composition containing glass particles such as $B_2O_3$—$SiO_2$-based glass particles, ceramic particles such as $ZrO_2$ ceramic particles, and a conductive material such as carbon particles and metal.

In the through hole 12, the clearance between the resistor element 70 and the center electrode 20 is filled with the conductive seal 60. The clearance between the resistor element 70 and the terminal metal fitting 40 is filled with the conductive seal 80. As a result, the center electrode 20 and the terminal metal fitting 40 electrically connect to each other via the resistor element 70 and the conductive seals 60 and 80. The conductive seal is formed using, for example, various glass particles described above and metal particles (such as Cu and Fe).

The metal shell 50 is a cylindrically-shaped metal shell for securing the spark plug 100 to an engine head (not shown) of the internal combustion engine. The metal shell 50 is formed using a low-carbon steel material (or another conductive material (for example, a metallic material) can also be adopted). In the metal shell 50, a through hole 59 is formed. The through hole 59 passes through along the central axis CL. The ceramic insulator 10 is inserted into the through hole 59 of the metal shell 50. The metal shell 50 is secured to the outer periphery of the ceramic insulator 10. The front end of the ceramic insulator 10 is exposed from the front end of the metal shell 50. The rear end of the ceramic insulator 10 is exposed from the rear end of the metal shell 50.

The metal shell 50 includes a body 55, a seal portion 54, a deformed portion 58, a tool engagement portion 51, and a crimp portion 53 that are arranged from the front end side toward the rear end side in this order. The shape of the seal portion 54 is approximately cylindrically shaped. On the front end side of the seal portion 54, the body 55 is disposed. The outer diameter of the body 55 is smaller than the outer diameter of the seal portion 54. On the outer peripheral surface of the body 55, a screw portion 52 is formed to be threadably mounted on the mounting hole of the internal combustion engine. Between the seal portion 54 and the screw portion 52, an annular gasket 5 is fitted by insertion. The gasket 5 is formed by folding a metal plate.

The body 55 of the metal shell 50 includes an inner-diameter contracted portion 56. The inner-diameter contracted portion 56 is arranged on the front end side with respect to the flange portion 19 of the ceramic insulator 10. The internal diameter of the inner-diameter contracted portion 56 gradually decreases from the rear end side toward the front end side. Between the inner-diameter contracted portion 56 of the metal shell 50 and the first outer-diameter contracted portion 15 of the ceramic insulator 10, the front-end-side packing 8 is sandwiched. The front-end-side packing 8 is made of steel, and is an O-shaped ring. Here, another material (for example, a metallic material such as copper) can also be adopted.

On the rear end side of the seal portion 54, the deformed portion 58 is disposed. The deformed portion 58 has a wall thickness thinner than that of the seal portion 54. The deformed portion 58 is deformed such that the center portion projects toward the outside in the radial direction (the direction away from the central axis CL). On the rear end side of the deformed portion 58, the tool engagement portion 51 is disposed. The shape of the tool engagement portion 51 is a shape (for example, a hexagonal prism) with which a spark plug wrench is engaged. On the rear end side of the tool engagement portion 51, the crimp portion 53 is disposed. The crimp portion 53 has a wall thickness thinner than that of the tool engagement portion 51. The crimp portion 53 is arranged on the rear end side with respect to the second outer-diameter contracted portion 11 of the ceramic insulator 10 so as to form the rear end of the metal shell 50. The crimp portion 53 is flexed to radially inside.

Between the inner peripheral surface of the portion on the rear end side of the metal shell 50 and the outer peripheral surface of the ceramic insulator 10, an annular space SP is formed. This space SP is a space formed by the inner peripheral surface of the metal shell 50 and the outer peripheral surface of the ceramic insulator 10 at a position between the crimp portion 53 and the second outer-diameter contracted portion 11. On the rear end side within this space SP, the first rear-end-side packing 6 is arranged. On the front end side within this space SP, the second rear-end-side packing 7 is arranged. In this embodiment, these rear-end-side packings 6 and 7 are C-shaped rings made of steel (another material can also be adopted). Between the two rear-end-side packings 6 and 7 within the space SP, the powders of the talc 9 are filled up.

The crimp portion 53 is crimped so as to be folded to the inside. Accordingly, the ceramic insulator 10 is pressed to the front end side within the metal shell 50 via the packings 6 and 7 and the talc 9. Thus, the front-end-side packing 8 is pressed between the first outer-diameter contracted portion 15 and inner-diameter contracted portion 56. The front-end-side packing 8 seals between the metal shell 50 and the ceramic insulator 10. The above-described configuration suppresses the gas inside of the combustion chamber of the internal combustion engine to leak to the outside through between the metal shell 50 and the ceramic insulator 10.

The first ground electrode 30 includes a base material 32 and a tip 38. The base material 32 is sealed to the front end of the metal shell 50. The tip 38 is sealed to a front end portion 31 of the base material 32. The base material 32 extends from the end sealed to the metal shell 50 toward the first direction D1, folded by approximately 90 degrees toward the central axis CL. The front end portion 31 is arranged on the front end side of the center electrode 20. The X direction Dx in the drawings is the direction vertical to the central axis CL from the sealed portion between the metal shell 50 and the base material 32 toward the central axis CL. The partial expansion figure in FIG. 1 shows the cross section that includes the central axis CL and is vertical to the X direction Dx. The tip 38 is sealed by, for example, laser beam welding on the base material 32 in the position facing the front end surface of the tip 28 of the center electrode 20, specifically, on the surface on the second direction D2 side of the front end portion 31. The shape of the tip 38 is a circular plate shape having the center on the central axis CL. The base material 32 is formed using a nickel alloy containing nickel of 90 weight % or more. The tip 38 is formed using an alloy containing iridium. The surface on the second direction D2 side of the tip 38 of the first ground electrode 30 and the surface (front end surface) on the first direction D1 side of the tip 28 of the center electrode 20 form a first gap g1.

The second ground electrode 90 includes a supporting portion 92 and a cylindrically-shaped tip 98 (also referred to as the "cylindrical tip 98"). The supporting portion 92 includes a hole forming portion 91 that forms a column-shaped through hole having the center on the central axis CL, and is sealed to the front end portion of the metal shell 50. The tip 98 is sealed to the inner peripheral surface of the hole forming portion 91, and has the center on the central axis CL. The cylindrical tip 98 is sealed to the inner peripheral surface of the hole forming portion 91 by, for example, brazing. The supporting portion 92 is sealed to the inner peripheral surface of the front end portion of the metal shell 50 (details will be described later). The supporting portion 92 is formed using a nickel alloy that contains nickel of 90 weight % or more. The cylindrical tip 98 is formed using an alloy that contains iridium. The inner peripheral surface of the cylindrical tip 98 of the second ground electrode 90 and the outer peripheral surface of the tip 28 of the center electrode 20 form an annular second gap g2.

A2. Configuration of Electrode

Figure 2A:
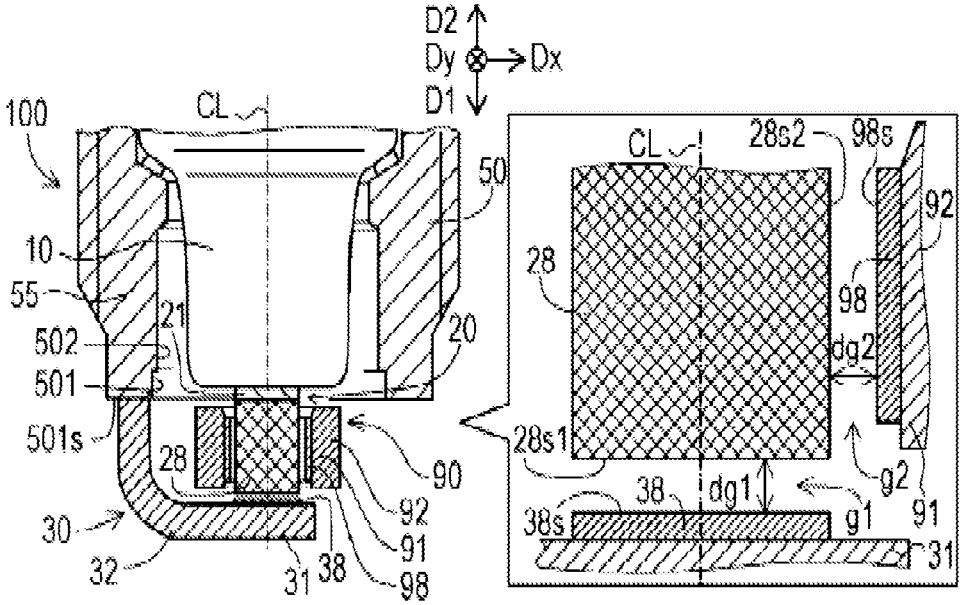
FIGS. 2A to 2D are schematic diagrams showing the configurations of electrodes 20, 30, and 90 of the spark plug 100.
Figure 2B:
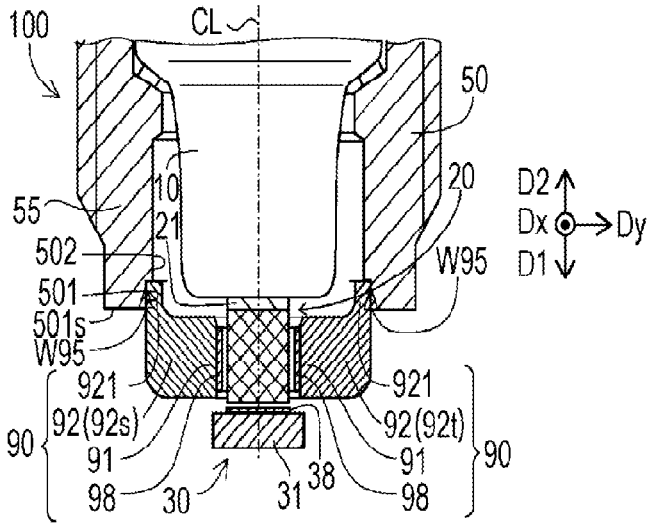
Figure 2C:
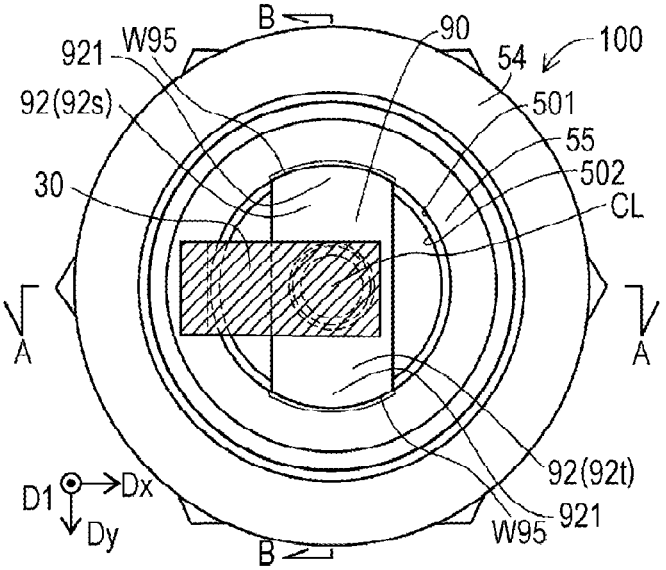
Figure 2D:
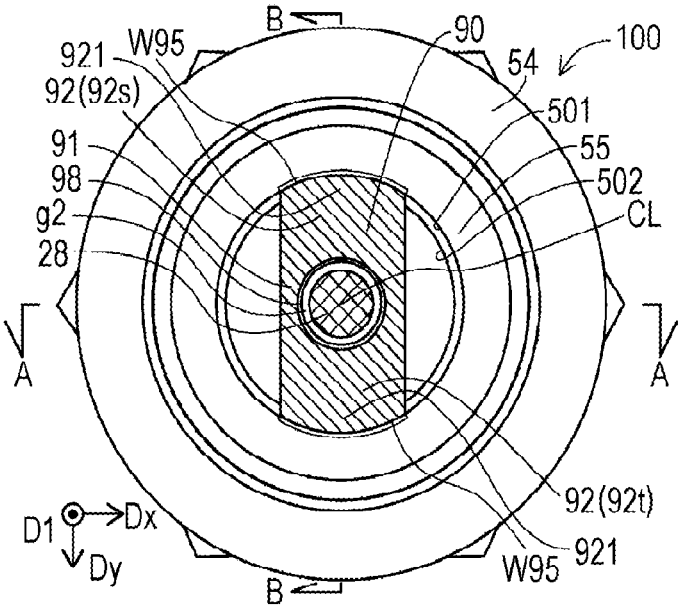

FIGS. 2A to 2D are schematic diagrams showing the configurations of the electrodes 20, 30, and 90 of the spark plug 100. FIG. 2A shows a partial sectional view (a sectional view including the central axis CL) parallel to the X direction Dx on the first direction D1 side of the spark plug 100. FIG. 2B shows a sectional view (a sectional view including the central axis CL) of the same portion vertical to the X direction Dx. FIG. 2C shows a schematic diagram of the spark plug 100 observed from the first direction D1 side toward the second direction D2. FIG. 2D shows a schematic diagram of the remaining portion after the first ground electrode 30 is deleted from the schematic diagram of FIG. 2C. In the drawings, the two directions Dx and Dy perpendicular to the central axis CL are shown in addition to the first direction D1 and the second direction D2. The Y direction Dy is a direction perpendicular to the X direction Dx. FIG. 2A is the cross section taken along the line A-A of FIG. 2C, and is the cross section that divides the base material 32 of the first ground electrode 30 in half. FIG. 2B is the cross section taken along the line B-B of FIG. 2C.

Here, FIG. 2A and FIG. 2B show the appearances of the ceramic insulator 10 observed facing the direction vertical to the cross section. Here, the right side in FIG. 2A shows an expansion figure of the portion including the tip 28. In FIG. 2C, the first ground electrode 30 is hatched. In FIG. 2D, the tip 28 and the second ground electrode 90 are hatched.

As shown in FIG. 2A and FIG. 2D, the cylindrical tip 98 of the second ground electrode 90 surrounds the peripheral area of the tip 28 of the center electrode 20 on the outside in the radial direction over the whole circumference. The annular second gap g2 is formed by an inner peripheral surface 98*s* (the surface on the inside of the radial direction in FIG. 2A) of the cylindrical tip 98 and an outer peripheral surface 28*s*2 (the surface on the outside in the radial direction) of the tip 28 of the center electrode 20.

As shown in FIG. 2B and FIG. 2D, the supporting portion 92 of the second ground electrode 90 is a plate-shaped member that extends from the −Dy direction side to the +Dy direction side of the central axis CL along the Y direction Dy. Here, the +Dy direction denotes the Y direction Dy, and the −Dy direction denotes the direction opposite to the Y direction Dy. In the drawings, two connecting portions 92*s* and 92*t* forming the supporting portion 92 are shown. The first connecting portion 92*s* is the portion on the −Dy direction side with respect to the central axis CL in the supporting portion 92. On the outside in the radial direction in the first connecting portion 92*s*, an end portion 921 is sealed to the metal shell 50 on the −Dy direction side with respect to the central axis CL. The second connecting portion 92*t* is the portion on the +Dy direction side with respect to the central axis CL in the supporting portion 92. On the outside in the radial direction in the second connecting portion 92*t*, an end portion 921 is sealed to the metal shell 50 on the +Dy direction side with respect to the central axis CL. The respective shapes of the first connecting portion 92*s* and the second connecting portion 92*t* are mutually the same.

As shown in FIG. 2B, the supporting portion 92 (specifically, the connecting portions 92*s* and 92*t*) extends from the connecting portion (that is, the hole forming portion 91) with the cylindrical tip 98 toward the outside in the radial direction, is bent toward the second direction D2, extends toward the second direction D2 side, and reaches the end portion 921. The outer peripheral surface of the end portion 921 is sealed to the inner peripheral surface of the metal shell 50 by welding. For example, a boundary portion W95 between the end portion 921 of the supporting portion 92 and the metal shell 50 is welded by laser beam welding from the first direction D1 side. Accordingly, the second ground electrode 90 has electrical continuity with the metal shell 50.

As shown in FIG. 2A, in the end portion on the first direction D1 side, the metal shell 50 (specifically, the body 55), a large internal diameter portion 501 is formed. The large internal diameter portion 501 has a relatively large internal diameter. On the second direction D2 side of the large internal diameter portion 501, a small internal diameter portion 502 is formed. The small internal diameter portion 502 has an internal diameter smaller than that of the large internal diameter portion 501. In the boundary portion between the large internal diameter portion 501 and the small internal diameter portion 502, a level difference (i.e., annular surface) is formed. At the level difference, the internal diameter changes in a stepped pattern. The second ground electrode 90 is fitted to this large internal diameter portion 501 from the first direction D1 side toward the second direction D2.

As shown in FIG. 2B and FIG. 2D, the second ground electrode 90 is constituted such that the two end portions 921 of the supporting portion 92 are brought into contact with the inner peripheral surface of the large internal diameter portion 501 of the metal shell 50. Specifically, in the case of observation facing the direction parallel to the central axis CL as shown in FIG. 2D, the shapes of the edges on the outer periphery side of the two end portions 921 are arc shapes having diameters that is larger than the internal diameter of the small internal diameter portion 502 and is slightly smaller than the internal diameter of the large internal diameter portion 501. Accordingly, in the case where the second ground electrode 90 is fitted to the large internal diameter portion 501, the surfaces on the second direction D2 side of the two end portions 921 of the supporting portion 92 are brought into contact with the level difference (annular surface) between the large internal diameter portion 501 and the small internal diameter portion 502. Accordingly, this inhibits the second ground electrode 90 from getting into the small internal diameter portion 502, thus suppressing the displacement of the second ground electrode 90 in the first direction D1 with respect to the metal shell 50. Additionally, the two end portions 921 of the supporting portion 92 are brought into contact with the inner peripheral surface of the large internal diameter portion 501. This suppresses the displacement (the displacement of the second ground electrode 90 with respect to the metal shell 50) in the direction perpendicular to the central axis CL. As a result, a size dg2 (also referred to as the "second gap size dg2") of the second gap g2 is approximately constant over the whole circumference on the outer peripheral surface 28*s*2 of the tip 28 of the center electrode 20.

As shown in FIG. 2A, the first ground electrode 30 is welded to a front end surface 501*s* of the metal shell 50 (for example, by laser beam welding). Accordingly, the first ground electrode 30 has electrical continuity with the metal shell 50. As shown in FIG. 2C, the first ground electrode 30 is arranged to extend in the X direction Dx vertical to the direction (that is, the Y direction Dy) extending the supporting portion 92 of the second ground electrode 90. As shown in the expansion figure in FIG. 2A, a front end surface 28*s*1 of the tip 28 of the center electrode 20 is a planar surface perpendicular to the central axis CL. Additionally, a surface 38*s* on the second direction D2 side of the tip 38 of the first ground electrode 30 is a planar surface perpendicular to the central axis CL. These surfaces 28*s*1 and 38*s* form the first gap g1. In the first gap g1, a size dg1 (also referred to as the "first gap size dg1"), that is, the distance between the two surfaces 28*s*1 and 38*s* is approximately constant irrespective of the position in the first gap g1. During manufacturing of the spark plug 100, the degree of bending of the first ground electrode 30 is adjusted such that the first gap size dg1 becomes a predetermined size.

As described above, the first ground electrode 30 has the tip 38 formed of the noble metal alloy (specifically, the alloy containing iridium) in the position forming the first gap g1. The second ground electrode 90 has the cylindrical tip 98 formed of the noble metal alloy (specifically, the alloy containing iridium) in the position forming the second gap g2. In the center electrode 20, at least the portion forming the first gap g1 with the tip 38 (that is, the front end surface 28*s*1 of the tip 28) and the portion forming the second gap g2 with the cylindrical tip 98 (that is, the outer peripheral surface 28*s*2 of the tip 28) are formed of noble metal alloys (specifically, alloys containing iridium). Accordingly, this allows suppressing the wear of each of the center electrode 20, the first ground electrode 30, and the second ground electrode 90.

A3. First Evaluation Test

The following describes the first evaluation test using samples of the spark plug. In the first evaluation test, the relationship between: the ratio of the first gap size dg1 to the second gap size dg2, and the bias eccentricity of the number of discharges between the first gap g1 and the second gap g2 was evaluated. To evaluate this relationship, the first evaluation test employed test samples of the spark plug that includes a center electrode with the tip 28, a first ground electrode with the tip 38, and a second ground electrode with the cylindrical tip 98 (not shown). The configurations of the center electrode and the first ground electrode of the test samples are similar to the configurations of the center electrode 20 and the first ground electrode 30 in FIG. 1 and FIG. 2A to FIG. 2D. For the second ground electrode, the shape of a supporting portion is not same as the shape of the supporting portion 92 in FIG. 1 and FIG. 2A to FIG. 2D. However, the supporting portion for the test samples includes a hole forming portion that allows insertion of the cylindrical tip 98 similarly to the hole forming portion 91 described in FIG. 2A to FIG. 2D. The cylindrical tip 98 is sealed to the inner peripheral surface of the hole forming portion. The supporting portion for the test samples is sealed to a front end portion of a metal shell. To appropriately perform the above-described evaluation, the respective three tips 28, 38, and 98 for the test samples are the same as the three tips 28, 38, and 98 described in FIG. 2A to FIG. 2D. The configuration of the sample is otherwise similar to the configuration of the spark plug 100 in FIG. 1. In the first evaluation test, samples of four spark plugs with mutually different ratios dg1/dg2 (hereinafter referred to as "gap ratios") of the first gap size dg1 to the second gap size dg2 (in FIG. 2A) were used to measure the rate (hereinafter referred to as a "second discharge rate") of the number of discharges that occurred between the center electrode and the second ground electrode to the number (here, 100) of all discharges that occurred in the sample of the spark plug. Here, a discharge occurs between the center electrode and the first ground electrode or between the center electrode and the second ground electrode. Table 1 below shows the measurement result.

TABLE 1

| | Gap Ratio (dg1/dg2) | | | |
|---|---|---|---|---|
| | 0.70 | 0.80 | 1.25 | 1.30 |
| Second Discharge Rate (%) | 30 | 45 | 55 | 70 |

The dimensions in common between the four samples used for the evaluation test are as follows.

1) Outer Diameter of Tip 28 of Center Electrode: 2.2 mm
2) Internal Diameter of Cylindrical Tip 98: 2.8 mm
3) Second Gap Size dg2: 0.3 mm The four samples are different in the first gap size dg1 from one another. The bent state of the first ground electrode (for example, a bend radius or similar state) is adjusted so as to adjust the first gap size dg1.

The testing method is as follows. The sample of the spark plug is arranged in a container for experiment filled with air. The internal pressure of the container is raised to 1 MPa. This pressure is determined assuming the pressure during ignition in the combustion chamber of the internal combustion engine. In this state, a voltage is applied to the sample of the spark plug to conduct a discharge. Every time a discharge is conducted, it is confirmed that the ground electrode that has caused a discharge is the first ground electrode or the second ground electrode by visual check. Hereinafter, the ground electrode that has caused the discharge is referred to as a "discharge ground electrode." The discharge is repeatedly conducted so as to calculate the second discharge rate, that is, the rate of the number of discharges that have occurred between the center electrode and the second ground electrode to the number of all discharges.

As shown in table 1, the second discharge rate becomes higher as the gap ratio becomes larger. As the reason for this result, it is estimated that this is because a discharge is less likely to occur in the first gap g1 in the case where the gap ratio is large since the first gap size dg1 is larger than the second gap size dg2 compared with the case where the gap ratio is small. Specifically, as shown in Table 1, in the case where the gap ratio is 0.70, the second discharge rate is 30%. That is, the discharge ground electrode is biased to the first ground electrode. In the case where the gap ratio is 1.30, the second discharge rate is 70%. That is, the discharge ground electrode is biased to the second ground electrode. In the case where the gap ratio is 0.80, the second discharge rate is 45%. In the case where the gap ratio is 1.25, the second discharge rate is 55%. In these two cases, discharge occurs approximately equally between the first ground electrode and the second ground electrode.

Setting the gap ratio within the range of 0.80 or more and 1.25 or less allows approximately equally using both the first ground electrode and the second ground electrode for discharge. This consequently allows suppressing significant wear of one ground electrode compared with the other ground electrode, thus improving the durability of the spark plug. For example, stable discharges can be achieved over a long period of time.

Here, the test sample has the three tips 28, 38, and 98 that form the first gap g1 and the second gap g2 similarly to the spark plug 100 shown in FIGS. 2A to 2D. Accordingly, the above-described preferred range of the gap ratio is applicable to the spark plug 100 in FIGS. 2A to 2D, and thus spark plugs in various configurations with the three tips 28, 38, and 98.

Here, the distance between the two discharging surfaces (here, the outer peripheral surface 28*s*2 of the tip 28 and the inner peripheral surface 98*s* of the cylindrical tip 98) that form the second gap g2 might change corresponding to the position on the discharging surface. For example, the displacement (particularly, the displacement in the direction perpendicular to the central axis CL) of the center electrode 20 might be larger than zero. Alternatively, the displacement of the second ground electrode 90 might be larger than zero. In the case where this displacement occurs, the distance between the two discharging surfaces 28*s*2 and 98*s* might change corresponding to the position on the discharging surface 28*s*2. In this case, it is only necessary to adopt the shortest distance between the two discharging surfaces (here, the two discharging surfaces 28*s*2 and 98*s*) that form the second gap g2 as the second gap size dg2. Similarly, the distance between the two discharging surfaces (here, the front end surface 28*s*1 of the tip 28 and the surface 38*s* of the tip 38) that form the first gap g1 might change corresponding to the position on the discharging surface. In this case, it is only necessary to adopt the shortest distance between the two discharging surfaces (here, the two discharging surfaces 28*s*1 and 38*s*) that form the first gap g1 as the first gap size dg1. The first gap size dg1 and the second gap size dg2 thus obtained are used to calculate a gap ratio (dg1/dg2). This gap ratio (dg1/dg2) is preferred to be within the range of 0.80 or more and 1.25 or less. This allows approximately equally using both the first ground electrode 30 and the second ground electrode 90 for discharge.

Here, the difference in likelihood of discharge between the first gap g1 and the second gap g2 is estimated to be caused mainly by the difference between the first gap size dg1 and the second gap size dg2. Accordingly, the above-described preferred range of the gap ratio is estimated to be applicable irrespective of the configuration other than the gap sizes dg1 and dg2. For example, the above-described preferred range is estimated to be applicable irrespective of the material (here, the material of the tip 28 and the material of the tip 38) of the portion that forms the first gap g1 in the electrode, the material (here, the material of the tip 28 and the material of the cylindrical tip 98) of the portion that forms the second gap g2 in the electrode, and the area of the portions that form the gaps g1 and g2 on the surfaces of the electrodes 20, 30, and 90.

A4. Second Evaluation Test

The following describes the second evaluation test using samples of the spark plug. In the second evaluation test, the rate of occurrence of a creeping discharge in the spark plug (referred to as a "used spark plug") after the operation of the internal combustion engine mounted with the sample of the spark plug for 1000 hours was measured.

Figure 3A:
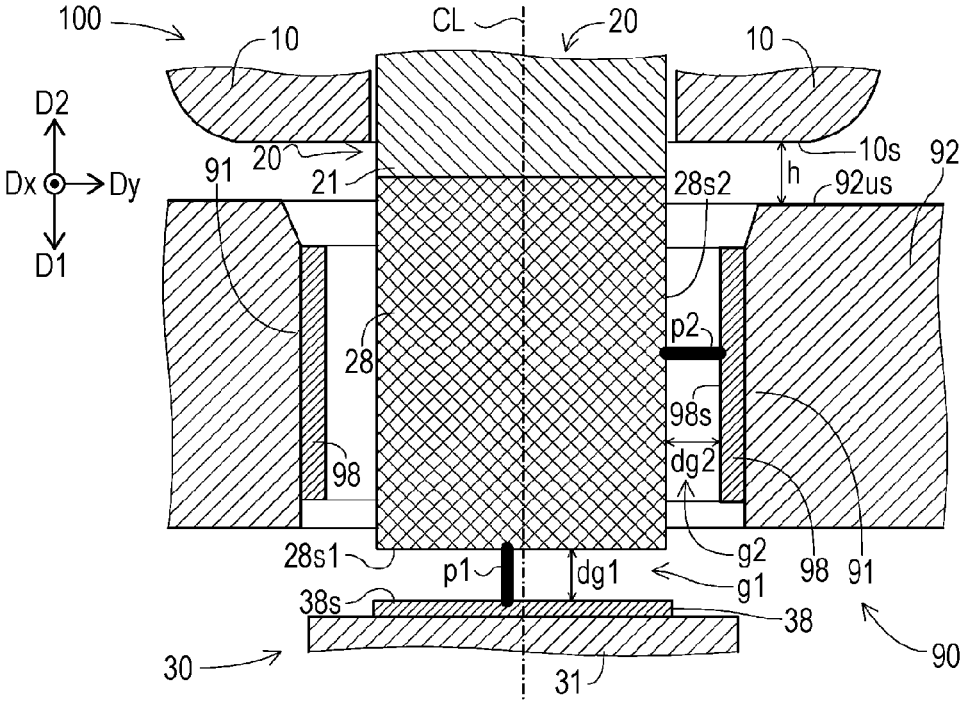
FIGS. 3A and 3B are explanatory views of creeping discharges.
Figure 3B:
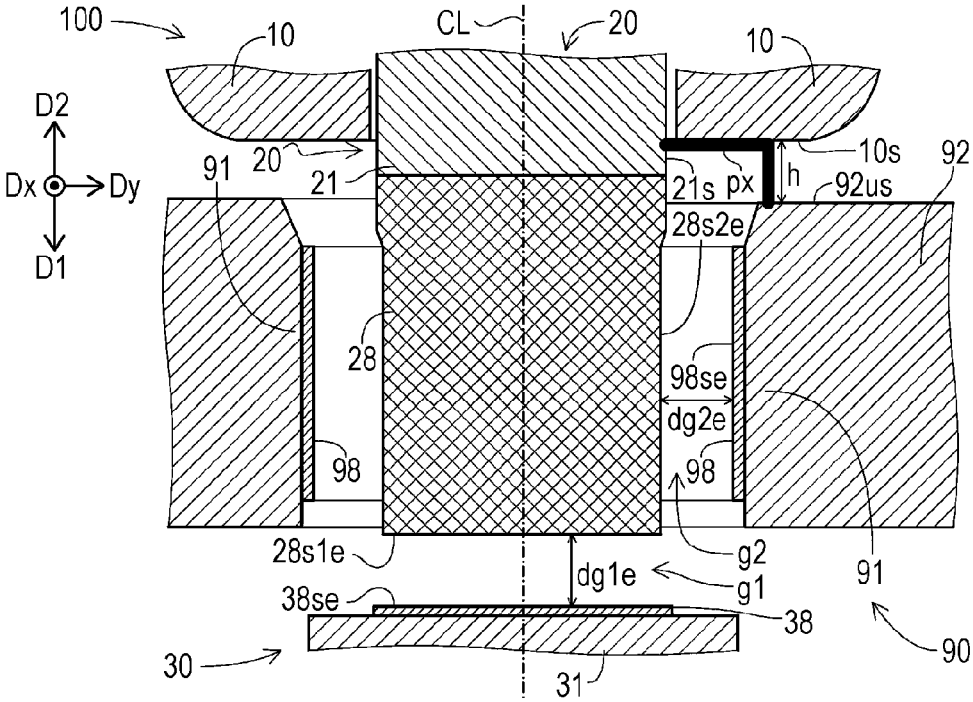

FIGS. 3A and 3B are explanatory views of creeping discharges. The following describes the creeping discharge using the spark plug 100 shown in FIG. 1 and FIGS. 2A to 2D. The drawings show the expansion figures of the portions including the gaps g1 and g2 in the sectional views shown in FIG. 1 and FIG. 2B. FIG. 3A shows a schematic diagram of the spark plug 100 before being used. FIG. 3B shows a schematic diagram of the spark plug 100 (the spark plug 100 after the operation for 1000 hours) after being used. In FIG. 3A, bold lines p1 and p2 show examples of discharge paths. The first discharge path p1 is an exemplary path of a discharge that might occur in the first gap g1, and is a path from the front end surface 28*s*1 of the tip 28 to the surface 38*s* of the tip 38. The second discharge path p2 is an exemplary path of a discharge that occurs in the second gap g2, and is a path from the outer peripheral surface 28*s*2 of the tip 28 to the inner peripheral surface 98*s* of the cylindrical tip 98.

FIG. 3A shows a distance h that denotes the shortest distance between the surface of the ceramic insulator 10 and the surface of the second ground electrode 90. In this embodiment, the shortest distance h is the same as the distance (the distance measured in parallel to the central axis CL) between a surface 10*s* (referred to as the "front end surface 10*s*") on the first direction D1 side of the ceramic insulator 10 and a surface 92*us* on the second direction D2 side of the supporting portion 92 in the second ground electrode 90. Before the spark plug 100 is used, the shortest distance h>the first gap size dg1 is satisfied and the shortest distance h>the second gap size dg2 is satisfied. The first gap size dg1 is the same as the second gap size dg2.

The electrodes 20, 30, and 90 might wear by the operation for 1000 hours. Particularly, wear is likely to occur in the portion that causes a discharge, that is, the front end surface 28*s*1 of the tip 28, the outer peripheral surface 28*s*2 of the tip 28, the surface 38*s* of the tip 38, and the inner peripheral surface 98*s* of the tip 98. FIG. 3B shows a schematic diagram after use for 1000 hours. In the drawing, respective surfaces 28*s*1*e*, 28*s*2*e*, 38*se*, and 98*se* are surfaces obtained by wear of the respective original surfaces 28*s*1, 28*s*2, 38*s*, and 98*s*. In the first gap g1 after use, a first gap size dg1*e* is larger than the first gap size dg1 before use (in FIG. 3A). In the second gap g2 after use, a second gap size dg2*e* is larger than the second gap size dg2 before use. Hereinafter, the first gap size dg1 before use is also referred to as the "first initial gap size dg1." The second gap size dg2 before use is also referred to as a "second initial gap size dg2." Here, the electrode wear might progress non-uniformly. In this case, the shortest distance between the front end surface 28*s*1*e* and the surface 38*se* corresponds to the first gap size dg1*e* after use. The shortest distance between the outer peripheral surface 28*s*2*e* and the inner peripheral surface 98*se* corresponds to the second gap size dg2*e* after use.

In FIG. 3B, a bold line px denotes an exemplary path of a creeping discharge. This creeping discharge path px goes from the surface 92*us* of the supporting portion 92 of the second ground electrode 90 to the front end surface 10*s* of the ceramic insulator 10, goes toward the center electrode 20 along this front end surface 10*s*, and reaches the outer peripheral surface of the center electrode 20 (here, the outer peripheral surface of the electrode base material 21). The creeping discharge that creeps on the front end surface 10*s* of the ceramic insulator 10 in this method might occur in the case where the discharges in the gaps g1 and g2 are less likely to occur. For example, as the gap sizes dg1*e* and dg2*e* are larger with respect to the shortest distance h, in other words, as the shortest distance h is smaller with respect to the gap sizes dg1*e* and dg2*e*, the creeping discharge is more likely to occur.

When this creeping discharge occurs, the ceramic insulator 10 might be damaged. Accordingly, the rate of occurrence of an unintended creeping discharge is preferred to be small.

The creeping discharge that might occur in the spark plug 100 in FIGS. 2A to 2D has been described above. The sample of the spark plug used in the second evaluation test is the same as the sample used for the first evaluation test. The supporting portion of the sample includes the surface 92*us*, which realizes the shortest distance h between the surface of the ceramic insulator 10 and the surface of the second ground electrode, similarly to the supporting portion 92 in FIG. 3A and FIG. 3B. Accordingly, in the test sample, in the case where the tips 28, 38, and 98 wear due to discharge, the creeping discharge might occur similarly to the spark plug 100 shown in FIG. 3B.

In the second evaluation test, samples of four spark plugs with different shortest distances h were used to measure the rate of occurrence of the creeping discharge after the operation for 1000 hours. Table 2 below shows the measurement result.

TABLE 2

| | Initial Distance Ratio (h/dg) | | | |
|---|---|---|---|---|
| | 1.8 | 1.9 | 2.0 | 2.1 |
| Occurrence Rate of Creeping Discharge after Use for 1000 Hours | 30 | 10 | 0 | 0 |

In Table 2, an initial distance ratio (h/dg) is the ratio of the shortest distance h to the initial gap sizes dg1 and dg2 of the sample of the spark plug before use. The occurrence rate of the creeping discharge after use for 1000 hours is the rate of the number of creeping discharges with respect to the number of all discharges in the case where the sample of the spark plug after use for 1000 hours is used and discharge is repeated under the same condition as that of the first evaluation test. Whether or not the discharge was the creeping discharge was confirmed by visual check.

The dimensions in common between the four samples used for the evaluation test are as follows.

1) Outer Shape of Tip 28 of Center Electrode: 2.2 mm
2) Internal Diameter of Cylindrical Tip 98: 2.8 mm
3) First Initial Gap Size dg1: 0.3 mm
4) Second Initial Gap Size dg2: 0.3 mm The four samples are different in the shortest distance h from one another. The length along the central axis CL of the nose portion 13 of the ceramic insulator 10 is adjusted so as to adjust the shortest distance h.

As shown in Table 2, as the initial distance ratio becomes larger, the rate of the creeping discharge becomes smaller. The reason for this result is estimated as follows. As described above, the gap sizes dg1*e* and dg2*e* might become larger than the initial gap sizes dg1 and dg2 due to the operation for 1000 hours. Here, in the case where the initial distance ratio is large, the proportion of the gap sizes dg1*e* and dg2*e* after use to the shortest distance h is small compared with the case where the initial distance ratio is small. That is, in the case where the initial distance ratio is large, the discharge is likely to occur in the gaps g1 and g2 compared with the case where the initial distance ratio is small. Accordingly, in the case where the operating period is the same, that is, in the case where the electrode wear occurs approximately equally, the rate of the creeping discharge becomes smaller as the initial distance ratio becomes larger.

Specifically, as shown in Table 2, in the case where the initial distance ratio is equal to or more than 2.0, more specifically, in the case where the initial distance ratio is 2.0 or 2.1, the occurrence rate of the creeping discharge is zero percent. In the case where the initial distance ratio is 1.9, the occurrence rate of the creeping discharge is 10%. In the case where the initial distance ratio is 1.8, the occurrence rate of the creeping discharge is 30%. Setting the initial distance ratio to be equal to or more than 2 in this method allows suppressing the creeping discharge. This consequently allows improving the durability of the spark plug.

Here, the first initial gap size dg1 may be different from the second initial gap size dg2. In this case, the shortest distance h is preferred to be twice or more as large as the maximum value among the first initial gap size dg1 and the second initial gap size dg2. This configuration allows suppressing the creeping discharge even in the case where any of the first ground electrode 30 and the second ground electrode 90 wears.

In each case, various values can be adopted as the upper limit of the initial distance ratio. For example, the initial distance ratio may be set to be equal to or less than "2.1" that is the evaluated value in the second evaluation test. As the upper limit of the initial distance ratio, the value larger than 2.1 (for example, any value selected from 3, 3.5, and 4) may be adopted (the initial distance ratio is equal to or less than the upper limit). In the case where the first initial gap size dg1 is different from the second initial gap size dg2, the ratio of the shortest distance h to the maximum value between the first initial gap size dg1 and the second initial gap size dg2 can be adopted as the initial distance ratio. Here, in the case where the shortest distance h is large, the portion (referred to as the outside portion) positioned on the outside of the through hole 12 of the ceramic insulator 10 in the center electrode 20 is often large. In the case where the outside portion of the center electrode 20 is long, the durability of the center electrode 20 is likely to be low. Accordingly, the shortest distance h, and thus the initial distance ratio is preferred to be small.

As described above, in the test sample, in the case where the tips 28, 38, and 98 wear due to discharge, the creeping discharge might occur similarly to the spark plug 100 shown in FIG. 3B. Accordingly, the above-described preferred range of the initial distance ratio is applicable to the spark plug 100 in FIGS. 2A to 2D, and thus spark plugs in various configurations with the three tips 28, 38, and 98 and the supporting portion that realizes the shortest distance h.

Here, the rate of electrode wear (for example, an increased amount of the gap sizes dg1 and dg2 per unit of operating period) might change corresponding to the materials of the tips 28, 38, and 98, the presence of the tips 28, 38, and 98, the area of the portions that form the gaps g1 and g2 on the surfaces of the electrodes 20, 30, and 90, and similar parameter. In each case, when the shortest distance h is twice or more as large as the maximum value among the first initial gap size dg1 and the second initial gap size dg2, the shortest distance h larger than the gap sizes dg1 and dg2 can be maintained until the gap sizes dg1 and dg2 increases double. This allows suppressing the creeping discharge over a long period of time compared with the case where the shortest distance h is less than twice as large as the above-described maximum value. In this method, the durability of the spark plug can be improved. However, the shortest distance h may be less than twice as large as the maximum value between the first initial gap size dg1 and the second initial gap size dg2.

Here, in the embodiment in FIGS. 3A and 3B, the shortest distance h is the distance measured in parallel to the first direction D1. The arrangement of the point on the ceramic insulator and the point on the second ground electrode to specify the shortest distance h can be various arrangements corresponding to the shape of the ceramic insulator 10 and the shape of the second ground electrode. For example, the distance measured along the oblique direction intersecting with the first direction D1 between the ceramic insulator and the second ground electrode may be the shortest distance.

B. Second Embodiment

Figure 4A:
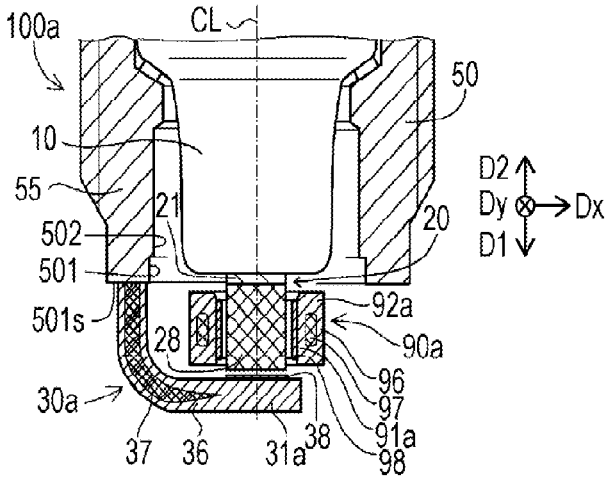
FIGS. 4A to 4D are schematic diagrams showing a second embodiment of the spark plug.
Figure 4B:
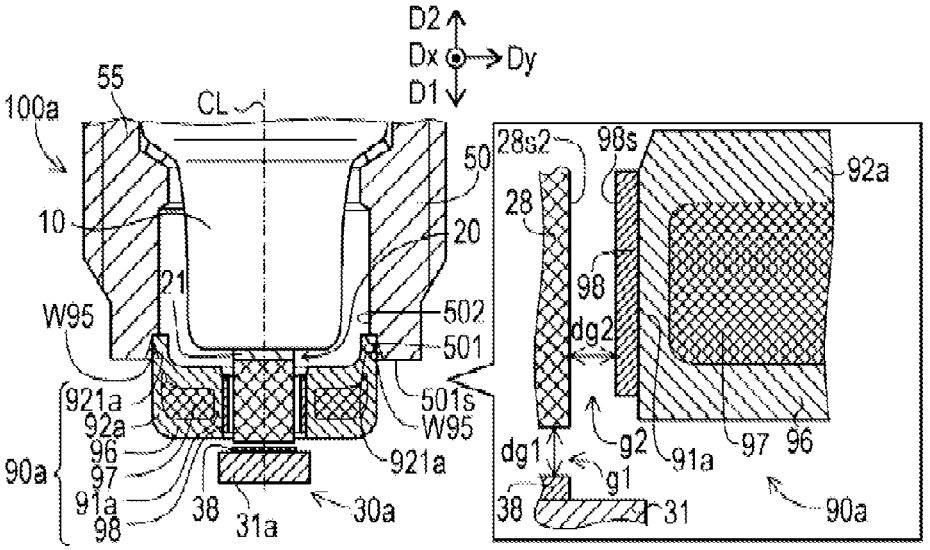
Figure 4C:
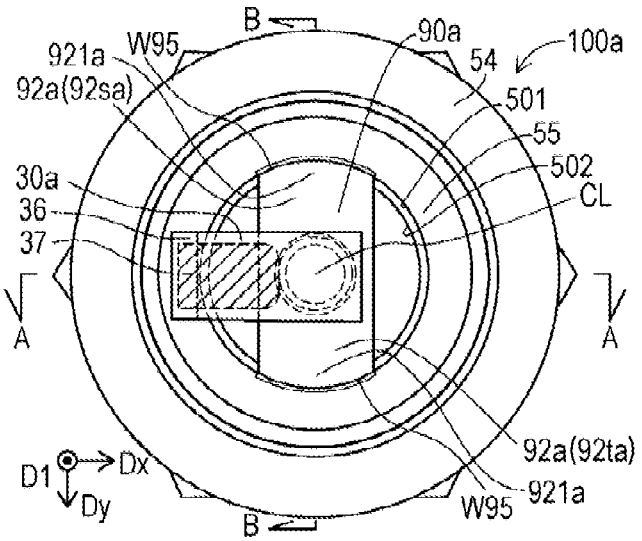
Figure 4D:
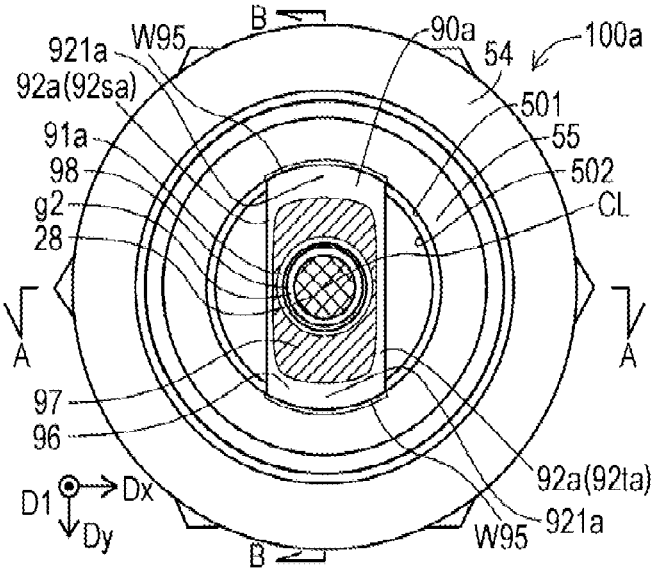

FIGS. 4A to 4D are schematic diagrams showing a second embodiment of the spark plug. FIG. 4A shows a sectional view similar to that of FIG. 2A. FIG. 4B shows a sectional view similar to that of FIG. 2B. FIG. 4C shows a schematic diagram similar to that of FIG. 2C. FIG. 4D shows a schematic diagram similar to that of FIG. 2D. There are two differences from the spark plug 100 of the first embodiment. The first difference is that the base material 32 of the first ground electrode 30 of the first embodiment is replaced by a surface layer 36, which forms the surface, and a core portion 37, which is formed inside of the surface layer 36. The second difference is that the supporting portion 92 of the first embodiment is replaced by a surface layer 96, which forms the surface, and a core portion 97, which is formed inside of the surface layer 96. The other configuration of a spark plug 100*a* of the second embodiment is the same as the configuration of the spark plug 100 of the first embodiment (in the drawings, like reference signs designate corresponding or identical configurations, and therefore such configurations will not be further elaborated here). For example, the arrangement of the tips 28, 38, and 98 forming the gaps g1 and g2 is the same as the arrangement in the embodiment shown in FIGS. 2A to 2D. Here, in FIG. 4C, the core portion 37 is hatched. In FIG. 4D, the core portion 97 is hatched.

In the second embodiment, a first ground electrode 30*a* includes the surface layer 36, the core portion 37, which is disposed inside of the surface layer 36, and the tip 38, which is sealed to a front end portion 31*a* of the first ground electrode 30*a*. The outer shape of the surface layer 36 is the same as the outer shape of the base material 32 of the first embodiment. As shown in FIG. 4A, the core portion 37 extends from the sealed portion with the metal shell 50 and extends to the middle of the first ground electrode 30*a* that reaches the front end portion 31*a*. The front end portion 31*a* is the portion corresponding to the front end portion 31 (in FIG. 2A) of the first embodiment.

The core portion 37 is formed using a material with a higher thermal conductivity than that of the surface layer 36. Accordingly, the heat transfer by the first ground electrode 30*a* can be promoted compared with the case where the core portion 37 is omitted. As a result, this simply allows transferring heat from the first ground electrode 30*a* to the metal shell 50 during the operation of the internal combustion engine. Accordingly, this allows suppressing the state where the temperature of the first ground electrode 30*a* becomes high and the long-continued state where the temperature of the first ground electrode 30*a* is high. As a result, this allows suppressing the wear of the first ground electrode 30*a* (for example, oxidation of the surface of the first ground electrode 30*a*).

Here, as the material of the surface layer 36, various materials can be adopted. For example, an alloy containing nickel can be adopted similarly to the base material 32 of the first embodiment. As the material of the core portion 37, various materials with higher thermal conductivities than that of the surface layer 36 can be adopted. For example, copper or an alloy containing copper can be adopted.

In the second embodiment, a second ground electrode 90*a* includes the surface layer 96, the core portion 97, which is disposed inside of the surface layer 96, and the cylindrical tip 98, which is sealed to the inner peripheral surface of the surface layer 96. The outer shape of the surface layer 96 is the same as the outer shape of the supporting portion 92 of the first embodiment. Hereinafter, the whole of the surface layer 96 and the core portion 97 is referred to as a "supporting portion 92*a*." Reference sign obtained by adding the character "a" to the tail end of reference sign of the element corresponding to the supporting portion 92 in FIGS. 2A to 2D is given to the element of the supporting portion 92*a*. For example, a first connecting portion 92*sa* denotes the same portion as the first connecting portion 92*s* in FIG. 2D. Additionally, an end portion 921*a* denotes the same portion as the end portion 921 in FIG. 2B. As shown in FIG. 4B and FIG. 4D, the core portion 97 extends from the proximity of the end on the −Dy direction side of the supporting portion 92*a* to the proximity of the end on the +Dy direction side within the supporting portion 92*a* along the Y direction Dy. Additionally, the core portion 97 is formed in a ring shape to bypass the through hole and a hole forming portion 91*a*.

The core portion 97 is formed using the material with the higher thermal conductivity than that of the surface layer 96. Accordingly, the heat transfer by the second ground electrode 90*a* can be promoted compared with the case where the core portion 97 is omitted. As a result, this simply allows transferring heat from the second ground electrode 90*a* to the metal shell 50 during the operation of the internal combustion engine. Accordingly, this allows suppressing the state where the temperature of the second ground electrode 90*a* becomes high and the long-continued state where the temperature of the second ground electrode 90*a* is high. As a result, this allows suppressing the wear of the second ground electrode 90*a* (for example, oxidation of the surface of the second ground electrode 90*a*).

Here, as the material of the surface layer 96, various materials can be adopted. For example, an alloy containing nickel can be adopted similarly to the supporting portion 92 of the first embodiment. As the material of the core portion 97, various materials with higher thermal conductivities than that of the surface layer 96 can be adopted. For example, copper or an alloy containing copper can be adopted.

The configuration of the portion other than the above-described two differences of the spark plug 100*a* of the second embodiment is the same as the configuration of the spark plug 100 of the first embodiment. Accordingly, the spark plug 100*a* of the second embodiment can achieve the same advantage as that of the spark plug 100 of the first embodiment. For example, the proportion of the first gap size dg1 to the second gap size dg2 is set to be equal to or more than 0.80 and equal to or less than 1.25. This allows approximately equally using both the first ground electrode 30*a* and the second ground electrode 90*a* for discharge. This consequently allows suppressing significant wear of one ground electrode compared with the other ground electrode, thus improving the durability of the spark plug 100*a*. Additionally, similarly to the first embodiment described in FIGS. 3A and 3B, setting the shortest distance h to be twice or more as large as the maximum value between the first initial gap size dg1 and the second initial gap size dg2 allows suppressing the creeping discharge. As a result, the durability of the spark plug 100 can be improved. Additionally, the first gap g1 is formed by the noble metal alloy (specifically, the tip 28 and the tip 38). This allows suppressing the wear of each of the center electrode 20 and the first ground electrode 30*a*. Additionally, the second gap g2 is formed by the noble metal alloy (specifically, the tip 28 and the cylindrical tip 98). This allows suppressing the wear of each of the center electrode 20 and the second ground electrode 90*a*. Additionally, as the noble metal, iridium is used. This allows appropriately suppressing the wear of the electrodes 20, 30*a*, and 90*a*.

C. Third Embodiment

Figure 5A:
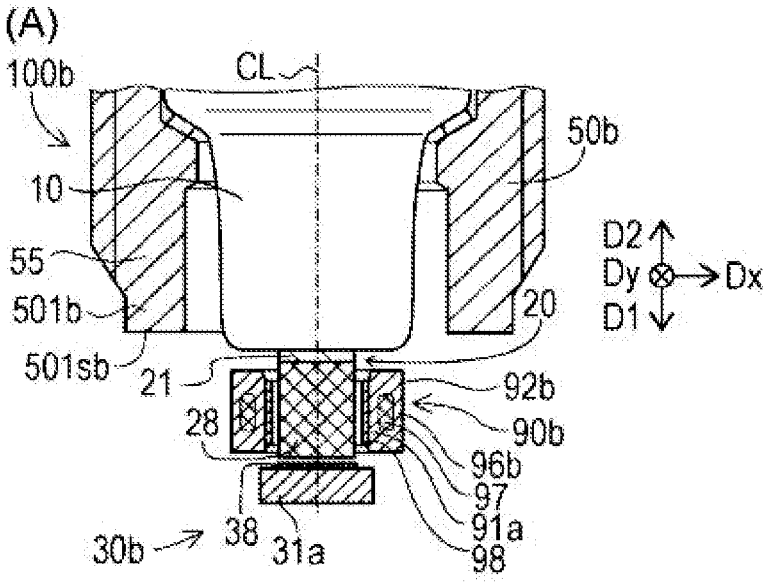
FIGS. 5A to 5D are schematic diagrams showing a third embodiment of the spark plug.
Figure 5B:
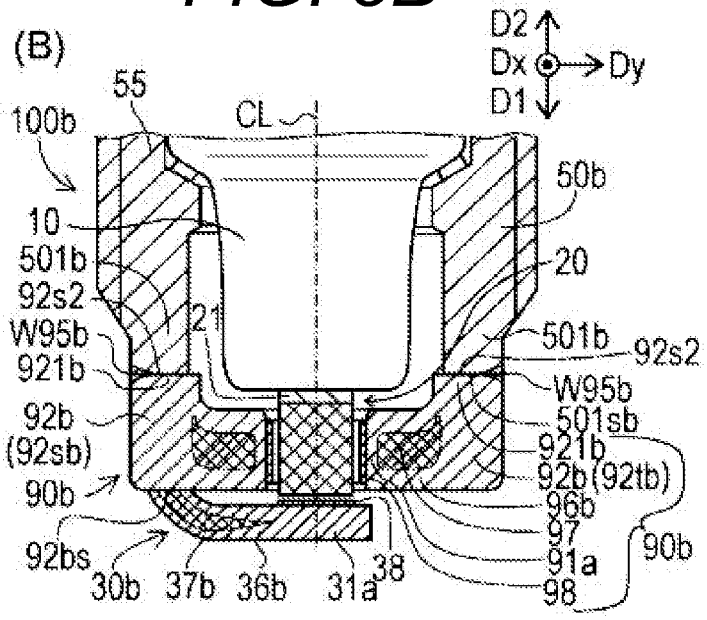
Figure 5C:
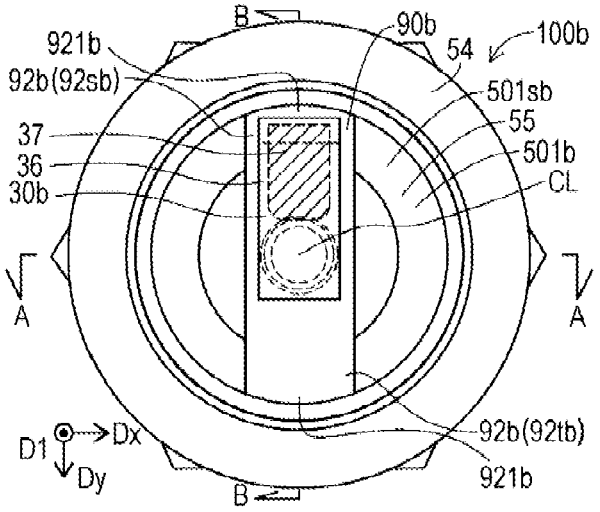
Figure 5D:
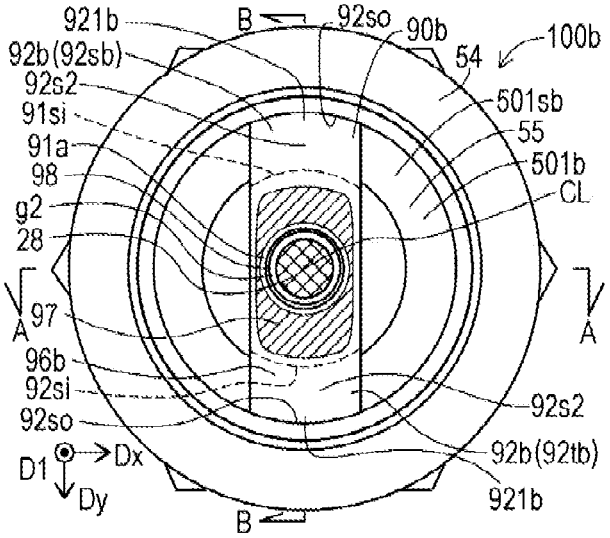

FIGS. 5A to 5D are schematic diagrams showing a third embodiment of the spark plug. FIG. 5A shows a sectional view similar to that of FIG. 4A. FIG. 5B shows a sectional view similar to that of FIG. 4B. FIG. 5C shows a schematic diagram similar to that of FIG. 4C. FIG. 5D shows a schematic diagram similar to that of FIG. 4D. There are three differences from the spark plug 100*a* of the second embodiment as follows.

1) The first difference is that the large internal diameter portion 501 of the metal shell 50 is omitted.

2) The second difference is that a supporting portion 92*b* (here, a surface layer 96*b*) of a second ground electrode 90*b* extends toward the outside in the radial direction up to the position of the outer peripheral surface of a front end portion 501*b* of a metal shell 50*b*.

3) The third difference is that a first ground electrode 30*b* is sealed to a surface 92*bs* on the first direction D1 side of the supporting portion 92*b* of the second ground electrode 90*b*. As shown in FIG. 5B and FIG. 5C, in the case of the observation facing the direction in parallel to the central axis CL, the direction in which the first ground electrode 30*b* extends from the sealed portion with the metal shell 50*b* toward the central axis CL is parallel to the direction (here, the Y direction Dy) in which the second ground electrode 90*b* extends.

The other configuration of a spark plug 100*b* of the third embodiment is the same as the configuration of the spark plug 100*a* of the second embodiment (in the drawings, like reference signs designate corresponding or identical configurations, and therefore such configurations will not be further elaborated here). For example, the configuration of the metal shell 50*b* of the third embodiment is the same as the configurations of the metal shells 50 of the first and second embodiments except that the portion that forms the large internal diameter portion 501 is omitted. The arrangement of the tips 28, 38, and 98 forming the gaps g1 and g2 is the same as the arrangements in the embodiments shown in FIGS. 2A to 2D and FIGS. 4A to 4D.

As shown in FIG. 5B and FIG. 5D, the second ground electrode 90*b* includes the supporting portion 92*b* and the cylindrical tip 98. The supporting portion 92*b* includes the hole forming portion 91*a* same as that of the embodiment of FIG. 4B. The cylindrical tip 98 is sealed to the inner peripheral surface of this hole forming portion 91*a*. As shown in FIG. 5B and FIG. 5D, the core portion 97 is disposed inside of the supporting portion 92*b* similarly to the embodiment in FIG. 4B and FIG. 4D. The remaining portion other than the core portion 97 in the supporting portion 92*b* is the surface layer 96*b*. The surface layer 96*b* is formed using a nickel alloy.

As shown in FIG. 5B, an end portion 921*b* of the supporting portion 92*b* is the end portion 921*b* on the outside in the radial direction and on the second direction D2 side. In this end portion 921*b*, an end face 92*s*2 on the second direction D2 side is sealed to the end face (referred to as a "front end surface 501*sb*") on the first direction D1 side of the metal shell 50*b*. For example, a boundary portion W95*b* between the supporting portion 92*b* and the metal shell 50*b* is welded by laser beam welding from outside in the radial direction. These surfaces 92*s*2 and 501*sb* are each a planar surface perpendicular to the central axis CL. FIG. 5B and FIG. 5D show two connecting portions 92*sb* and 92*tb*. The first connecting portion 92*sb* is the portion on the −Dy direction side with respect to the central axis CL in the supporting portion 92*b*. The second connecting portion 92*tb* is the portion on the +Dy direction side with respect to the central axis CL in the supporting portion 92*b*. The end portion 921*b* of the first connecting portion 92*sb* is sealed to the metal shell 50*b* on the −Dy direction side with respect to the central axis CL. The end portion 921*b* of the second connecting portion 92*tb* is sealed to the metal shell 50*b* on the +Dy direction side with respect to the central axis CL.

In this embodiment, as shown in FIG. 5D, the shapes of edges 92*so* on the outer periphery side of the two end faces 92*s*2 in the supporting portion 92*b* are the same as a part of the circle (that is, the arc) having approximately the same diameter as the outer diameter of the front end surface 501*sb* of the metal shell 50*b*. As shown in FIG. 5D, the shapes of edges 92*si* on the inner peripheral side of the two end faces 92*s*2 in the supporting portion 92*b* are the same as a part of the circle (that is, the arc) having a slightly smaller diameter than the internal diameter of the front end surface 501*sb* of the metal shell 50*b*. Accordingly, the front end surface 501*sb* of the metal shell 50*b* can be simply sealed to the two end faces 92*s*2 of the supporting portion 92*b*. This allows enhancing the sealing strength. Additionally, the edges 92*so* on the outer periphery side of the two end faces 92*s*2 in the supporting portion 92*b* is arranged on the edge on the outer periphery side of the front end surface 501*sb* of the metal shell 50*b*. This allows suppressing the displacement (the displacement in the direction perpendicular to the central axis CL) of the second ground electrode 90*b* with respect to the metal shell 50*b*. As a result, the second gap size dg2 is approximately constant over the whole circumference on the outer peripheral surface 28*s*2 of the tip 28 of the center electrode 20.

As shown in FIG. 5B, the first ground electrode 30*b* is sealed to the surface 92*bs* on the first direction D1 side of the supporting portion 92*b* of the second ground electrode 90*b* (for example, by laser beam welding). The configuration of the first ground electrode 30*b* is the same as the configuration obtained by omitting the portion overlapping with the second ground electrode 90*b* in FIG. 5B in the first ground electrode 30*a* in the case where the first ground electrode 30*a* in FIG. 4A is superimposed on FIG. 5B such that the tips 38 overlap with each other. Similarly to the first ground electrode 30*a* in FIG. 4A, the first ground electrode 30*b* includes a surface layer 36*b*, a core portion 37*b*, which is formed inside of the surface layer 36*b*, and the tip 38.

The first ground electrode 30*b* is sealed to the metal shell 50*b* via the second ground electrode 90*b*. In this case, the heat transfer from the first ground electrode 30*b* to the metal shell 50*b* is suppressed compared with the case where the first ground electrode 30*b* is sealed directly to the metal shell 50*b*. Accordingly, the temperature of the first ground electrode 30*b* is likely to increase. However, the core portion 37*b* is buried in the first ground electrode 30*b*. Accordingly, this allows suppressing the state where the temperature of the first ground electrode 30*b* becomes high and the long-continued state where the temperature of the first ground electrode 30*b* is high. As a result, this allows suppressing the wear of the first ground electrode 30*b* (for example, oxidation of the surface of the first ground electrode 30*b*).

The configuration of the portion other than the above-described differences of the spark plug 100*b* of the third embodiment is the same as the configuration of the spark plug 100*a* of the second embodiment. Accordingly, the spark plug 100*b* of the third embodiment can achieve the same advantage as that of the spark plug 100*a* of the second embodiment. For example, the proportion of the first gap size dg1 to the second gap size dg2 is set to be equal to or more than 0.80 and equal to or less than 1.25. This allows approximately equally using both the first ground electrode 30*b* and the second ground electrode 90*b* for discharge. This consequently allows suppressing significant wear of one ground electrode compared with the other ground electrode, thus improving the durability of the spark plug 100*b*. Similarly to the first embodiment described in FIGS. 3A and 3B, setting the shortest distance h to be twice or more as large as the maximum value between the first initial gap size dg1 and the second initial gap size dg2 allows suppressing the creeping discharge. As a result, the durability of the spark plug 100*b* can be improved. Additionally, the first gap g1 is formed by the noble metal alloy (specifically, the tip 28 and the tip 38). This allows suppressing the wear of each of the center electrode 20 and the first ground electrode 30*b*. Additionally, the second gap g2 is formed by the noble metal alloy (specifically, the tip 28 and the cylindrical tip 98). This allows suppressing the wear of each of the center electrode 20 and the second ground electrode 90*b*. Additionally, as the noble metal, iridium is used. This allows appropriately suppressing the wear of the electrodes 20, 30*b*, and 90*b*. Additionally, the core portion 37*b* with the higher thermal conductivity than that of the surface layer 36*b* is buried inside of the first ground electrode 30*b*. Accordingly, this allows suppressing the state where the temperature of the first ground electrode 30*b* becomes high and the long-continued state where the temperature of the first ground electrode 30*b* is high during the operation of the internal combustion engine. As a result, this allows suppressing the wear of the first ground electrode 30*b* (for example, oxidation of the surface of the first ground electrode 30*b*). Additionally, the core portion 97 with the higher thermal conductivity than that of the surface layer 96*b* is buried inside of the second ground electrode 90*b*. Accordingly, this allows suppressing the state where the temperature of the second ground electrode 90*b* becomes high and the long-continued state where the temperature of the second ground electrode 90*b* is high during the operation of the internal combustion engine. As a result, this allows suppressing the wear of the second ground electrode 90*b* (for example, oxidation of the surface of the second ground electrode 90*b*).

D. Fourth Embodiment

Figure 6A:
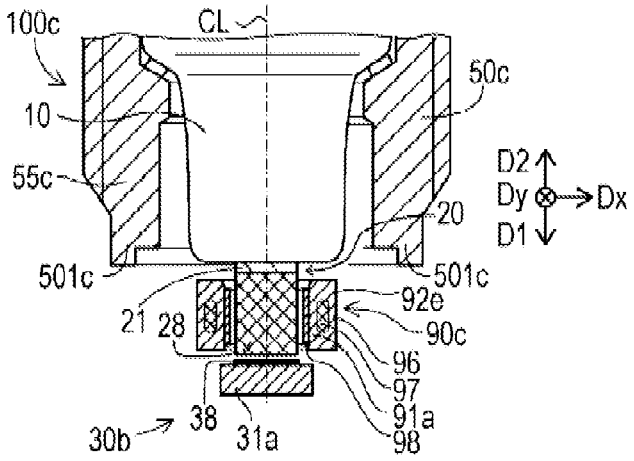
FIGS. 6A to 6D are schematic diagrams showing a fourth embodiment of the spark plug.
Figure 6B:
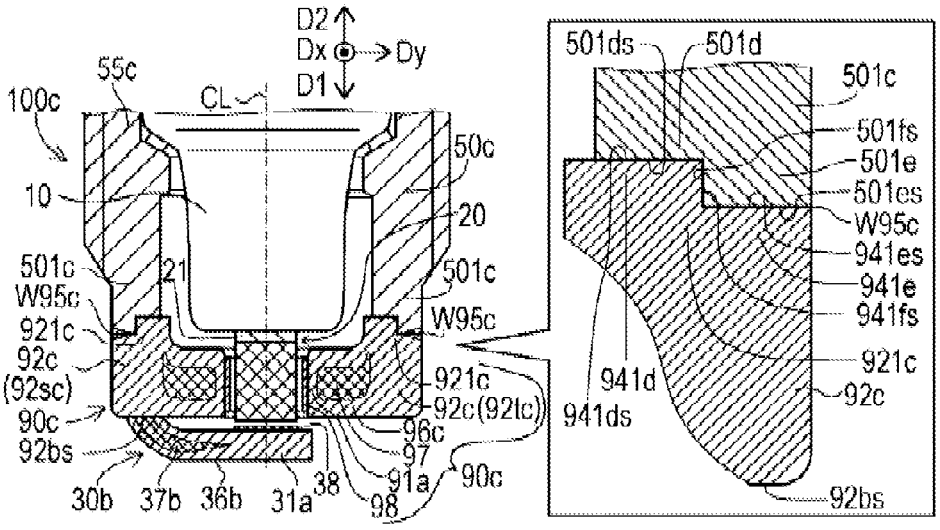
Figure 6C:
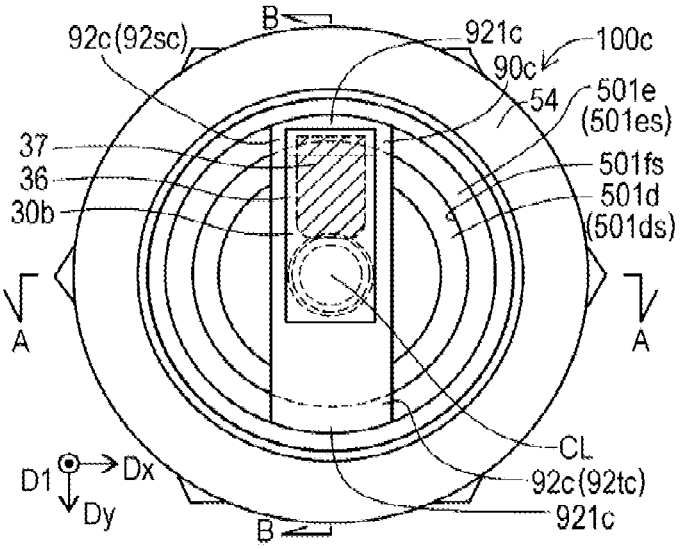
Figure 6D:
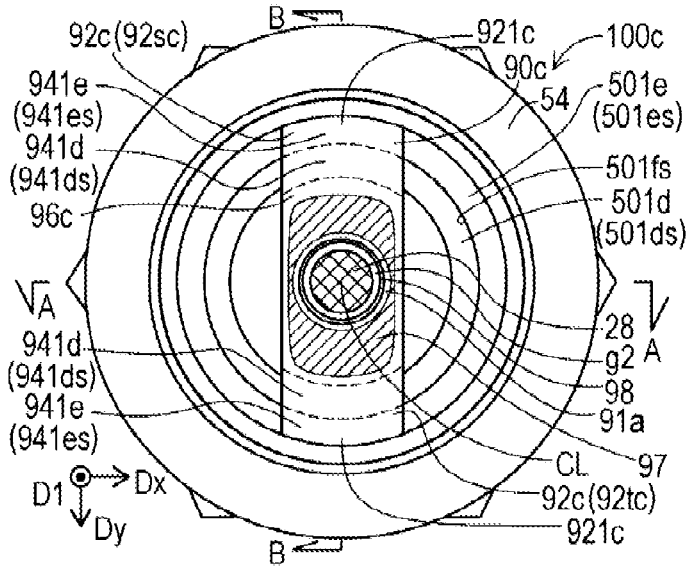

FIGS. 6A to 6D are schematic diagrams showing a fourth embodiment of the spark plug. FIG. 6A shows a sectional view similar to that of FIG. 5A. FIG. 6B shows a sectional view similar to that of FIG. 5B. FIG. 6C shows a schematic diagram similar to that of FIG. 5C. FIG. 6D shows a schematic diagram similar to that of FIG. 5D. There is a difference from the spark plug 100*b* of the third embodiment only in that the sealed surface between a metal shell 50*c* and a supporting portion 92*c* changes in a stepped shape. The other configuration of a spark plug 100*c* is the same as the configuration of the spark plug 100*b* of the third embodiment (in the drawings, like reference signs designate corresponding or identical configurations, and therefore such configurations will not be further elaborated here). For example, the configuration of the metal shell 50*c* of the fourth embodiment is the same as the configurations of the metal shells 50 of the first and second embodiments except that the shape of a front end portion 501*c* is different. Additionally, the configuration of a second ground electrode 90*c* of the fourth embodiment is the same as the configuration of the second ground electrode 90*b* in FIG. 5A except that the shape (the shape of the portion to be sealed to the metal shell 50*c*) of an end portion 921*c* of the supporting portion 92*c* is different from the shape (the shape of the portion to be sealed to the metal shell 50*b*) of the end portion 921*b* of the supporting portion 92*b* in FIG. 5B. The arrangement of the tips 28, 38, and 98 that form the gaps g1 and g2 is the same as the arrangement of the embodiments in FIGS. 2A to 2D, FIGS. 4A to 4D, and FIGS. 5A to 5D. Here, the right side of FIG. 6B shows an expansion figure of the sealed portion between the metal shell 50*c* and the second ground electrode 90*c*.

As shown in FIG. 6B and FIG. 6D, the second ground electrode 90*c* includes the supporting portion 92*c* and the cylindrical tip 98. The configuration other than the shape of the sealed surface with the metal shell 50*c* in the configuration of the supporting portion 92*c* is the same as the configuration of the supporting portion 92*b* in FIG. 5B and FIG. 5D. The cylindrical tip 98 is sealed to the inner peripheral surface of the hole forming portion 91*a* of the supporting portion 92*c*. The same core portion 97 as that of the third embodiment is disposed inside of the supporting portion 92*c*. The remaining portion other than the core portion 97 in the supporting portion 92*c* is a surface layer 96*c*. In the drawings, a first connecting portion 92*sc* is the portion on the −Dy direction side with respect to the central axis CL in the supporting portion 92*c*, and a second connecting portion 92*tc* is the portion on the +Dy direction side with respect to the central axis CL in the supporting portion 92*c*. As shown in FIG. 6B, the end portion 921*c* of the first connecting portion 92*sc* is sealed to the metal shell 50*c* on the −Dy direction side with respect to the central axis CL. The end portion 921*c* of the second connecting portion 92*tc* is sealed to the metal shell 50*c* on the +Dy direction side with respect to the central axis CL.

As shown in the expansion figure in FIG. 6B, the end portion 921*c* of the supporting portion 92*c* includes an inside portion 941*d*, which is the portion on the inner peripheral side, and an outside portion 941*e*, which is the portion on the outside in the radial direction of the inside portion 941*d*. As shown in FIG. 6B, a surface 941*ds* on the second direction D2 side of the inside portion 941*d* and a surface 941*es* on the second direction D2 side of the outside portion 941*e* are both planar surfaces perpendicular to the central axis CL. However, the surface 941*es* of the outside portion 941*e* is positioned on the first direction D1 side with respect to the surface 941*ds* of the inside portion 941*d*. In the boundary portion between the inside portion 941*d* and the outside portion 941*e*, an outer peripheral surface 941*fs* (also referred to as the partial cylindrical surface 941*fs*) is formed. The outer peripheral surface 941*fs* has the same shape as that of a part of a cylinder having the center on the central axis CL.

As shown in FIG. 6B, the front end portion 501*c* of the metal shell 50*c* includes an inside portion 501*d* and an outside portion 501*e*, which is the portion on the outside in the radial direction of the inside portion 501*d*. A surface 501*ds* on the first direction D1 side of the inside portion 501*d* and a surface 501*es* on the first direction D1 side of the outside portion 501*e* are each a planar surface perpendicular to the central axis CL. However, the surface 501*es* of the outside portion 501*e* is positioned on the first direction D1 side with respect to the surface 501*ds* of the inside portion 501*d*. In the boundary portion between the inside portion 501*d* and the outside portion 501*e*, an inner peripheral surface 501*fs* (also referred to as the partial cylindrical surface 501*fs*) is formed. The inner peripheral surface 501*fs* has the same shape as that of a part of a cylinder having the center on the central axis CL.

As shown in FIG. 6B, the second ground electrode 90*c* is fitted to the front end portion 501*c* of the metal shell 50*c* from the first direction D1 side toward the second direction D2. The surface 941*es* of the outside portion 941*e* of the supporting portion 92*c* is brought into contact with the surface 501*es* of the outside portion 501*e* of the metal shell 50*c*. The surface 941*ds* of the inside portion 941*d* of the supporting portion 92*c* is brought into contact with the surface 501*ds* of the inside portion 501*d* of the metal shell 50*c*. A boundary portion W95*c* between the supporting portion 92*c* and the metal shell 50*c* is welded by laser beam welding from outside in the radial direction.

The partial cylindrical surface 941*fs* of the supporting portion 92*c* is brought into contact with the partial cylindrical surface 501*fs* of the metal shell 50*c*. Accordingly, this allows suppressing the displacement (the displacement in the direction perpendicular to the central axis CL) of the second ground electrode 90*c* with respect to the metal shell 50*c*. As a result, the second gap size dg2 is approximately constant over the whole circumference on the outer peripheral surface of the tip 28 of the center electrode 20.

As shown in FIG. 6B, the first ground electrode 30*b* is sealed to the surface 92*bs* on the first direction D1 side of the supporting portion 92*c* of the second ground electrode 90*c* (for example, by laser beam welding). Here, a depressed portion or a cutout may be disposed on the surface 92*bs* on the first direction D1 side of the supporting portion 92*c* of the second ground electrode 90*c*, and one end portion of the first ground electrode 30*b* may be arranged to be sealed to the depressed portion or the cutout.

Here, the configuration of the portion other than the above-described difference of the spark plug 100*c* of the fourth embodiment is the same as the configuration of the spark plug 100*b* of the third embodiment. Accordingly, the spark plug 100*c* of the fourth embodiment can achieve various advantages similar to those of the spark plug 100*b* of the third embodiment. For example, the proportion of the first gap size dg1 to the second gap size dg2 is set to be equal to or more than 0.80 and equal to or less than 1.25. This allows approximately equally using both the first ground electrode 30*b* and the second ground electrode 90*c* for discharge. This consequently allows suppressing significant wear of one ground electrode compared with the other ground electrode, thus improving the durability of the spark plug 100*c*. Similarly to the first embodiment described in FIGS. 3A and 3B, setting the shortest distance to be twice or more as large as the maximum value between the first initial gap size dg1 and the second initial gap size dg2 allows suppressing the creeping discharge. As a result, the durability of the spark plug 100*c* can be improved. Additionally, the first gap g1 is formed by the noble metal alloy (specifically, the tip 28 and the tip 38). This allows suppressing the wear of each of the center electrode 20 and the first ground electrode 30*b*. Additionally, the second gap g2 is formed by the noble metal alloy (specifically, the tip 28 and the cylindrical tip 98). This allows suppressing the wear of each of the center electrode 20 and the second ground electrode 90*c*. Additionally, as the noble metal, iridium is used. This allows appropriately suppressing the wear of the electrodes 20, 30*b*, and 90*c*. Additionally, the core portion 37*b* with the higher thermal conductivity than that of the surface layer 36*b* is buried inside of the first ground electrode 30*b*. Accordingly, this allows suppressing the wear of the first ground electrode 30*b*. Additionally, the core portion 97 with the higher thermal conductivity than that of the surface layer 96*c* is buried inside of the second ground electrode 90*c*. Accordingly, this allows suppressing the wear of the second ground electrode 90*c*.

E. Modifications (1) In the above-described respective embodiments, the first ground electrode is preferred to include a first nickel portion that is the portion formed by nickel or a nickel alloy, and the nickel content of the first nickel portion is preferred to be equal to or more than 90 weight %. For example, in the above-described embodiments, the base material 32 in FIG. 2A and the surface layers 36 and 36*b* in FIG. 4A, FIG. 5B, and FIG. 6B each correspond to the first nickel portion. An increase in nickel content allows improving the thermal conductivity of the first ground electrode. Accordingly, this simply allows transferring heat from the first ground electrode to the metal shell during the operation of the internal combustion engine. Thus, this allows suppressing the state where the temperature of the first ground electrode becomes high and the long-continued state where the temperature of the first ground electrode is high. As a result, this allows suppressing the wear of the first ground electrode (for example, oxidation of the surface of the first ground electrode). However, the nickel content of the first nickel portion of the first ground electrode may be less than 90 weight %.

Similarly, the second ground electrode is preferred to include a second nickel portion that is the portion formed by nickel or a nickel alloy, and the nickel content of the second nickel portion is preferred to be equal to or more than 90 weight %. For example, in the above-described embodiments, the entire supporting portion 92 in FIG. 2A and the surface layers 96, 96*b*, and 96*c* in FIG. 4B, FIG. 5B, and FIG. 6B each corresponds to the second nickel portion. In the case where the nickel content of this second nickel portion is equal to or more than 90 weight %, this simply allows transferring heat from the second ground electrode to the metal shell during the operation of the internal combustion engine. Thus, this allows suppressing the state where the temperature of the second ground electrode becomes high and the long-continued state where the temperature of the second ground electrode is high. As a result, this allows suppressing the wear of the second ground electrode (for example, oxidation of the surface of the second ground electrode). However, the nickel content of the second nickel portion of the second ground electrode may be less than 90 weight %.

However, the first ground electrode may be formed using a conductive material other than nickel without containing nickel. Similarly, the second ground electrode may be formed using a conductive material other than nickel without containing nickel.

(2) In the above-described embodiments that include the core portions 37 and 37*b* of the first ground electrodes, the core portions 37 and 37*b* may be omitted. Additionally, in the embodiment without the core portion, the core portion (for example, the core portions 37 and 37*b*) may be added. Additionally, in the embodiment that includes the core portion 97 of the second ground electrode, the core portion 97 may be omitted. In the embodiment without the core portion 97, the core portion 97 may be added. In this method, the core portion may be disposed only in any one of the first ground electrode and the second ground electrode. The core portion may be omitted from both the first ground electrode and the second ground electrode. The core portion may be disposed in both the first ground electrode and the second ground electrode.

As the material of the core portion, various materials with larger thermal conductivities than that of the surface layer disposed in the peripheral area of the core portion can be adopted. For example, a conductive material such as copper, an alloy containing copper, and silver can be adopted.

(3) In the above-described respective embodiments, respective noble metal tips apart from one another may be disposed in the portion that forms the first gap g1 and the portion that forms the second gap g2 in the center electrode 20. Additionally, the above-described respective embodiments, at least one of the noble metal tips 38 and 98 disposed in the ground electrode may be omitted. In the above-described respective embodiments, the noble metal tips of one or more portions optionally selected from the portion that forms the first gap g1 of the center electrode 20, the portion that generates the second gap g2 of the center electrode 20, the portion that forms the first gap g1 of the first ground electrode, and the portion that forms the second gap g2 of the second ground electrode may be omitted.

The material of the noble metal tip is not limited to iridium or an alloy containing iridium, and other various materials can be adopted. For example, platinum or an alloy containing platinum may be adopted. Generally, a noble metal or a noble metal alloy can be adopted. Additionally, the respective materials of the noble metal tips in the portion that forms the first gap g1 of the center electrode 20, the portion that generates the second gap g2 of the center electrode 20, the portion that forms the first gap g1 of the first ground electrode, and the portion that forms the second gap g2 of the second ground electrode may be selected independently from one another. For example, the tip 28 may be formed using the noble metal (for example, iridium). The noble metal tip 38 and the cylindrical tip 98 may be formed using the noble metal alloy (for example, an iridium alloy).

(4) The area of the discharging surface (in the above-described respective embodiments, the area of the inner peripheral surface 98*s* of the cylindrical tip 98) that forms the second gap g2 of the second ground electrode is preferred to be twice or more as large as the area of the discharging surface (in the above-described respective embodiments, the area of the surface 38*s* of the tip 38) that forms the first gap g1 of the first ground electrode. This configuration achieves the area of the discharging surface three times as large as the area in the case where the second ground electrode is omitted, thus improving the durability of the spark plug. For example, a stable discharge can be achieved over a long period of time.

(5) To suppress the displacement (particularly, the displacement in the direction intersecting with the central axis CL) of the second ground electrode with respect to the metal shell, the second ground electrode is preferred to be the surface in contact with the metal shell and to have the surface (referred to as a "position specifying surface") specified by the normal line intersecting with the first direction D1. For example, in the above-described embodiments, the surfaces on the outside in the radial direction of the two end portions 921 and 921*a* of the supporting portions 92 and 92*a* in FIGS. 2A to 2D and FIGS. 4A to 4D and the surfaces (the partial cylindrical surface 941*fs*) on the outside in the radial direction of the inside portion 941*d* of the two end portions 921*c* in the supporting portion 92*c* in FIGS. 6A to 6D respectively correspond to the position specifying surface. In these embodiments, the normal direction of the position specifying surface is the same as the radial direction in the position specifying surface. Generally, the second ground electrode is preferred to have two or more position specifying surfaces that are arranged in mutually different directions observed from the central axis CL and have mutually different normal directions. This configuration allows appropriately suppressing the displacement (the displacement in the direction intersecting with the central axis CL) of the second ground electrode with respect to the metal shell. For example, the configuration where the depressed portion or the convex portion of the second ground electrode is fitted to the convex portion or the depressed portion of the metal shell can be adopted. Here, the normal direction of the position specifying surface may be the direction obliquely inclined with respect to the planar surface perpendicular to the central axis CL. However, to suppress the displacement in the first direction D1 of the second ground electrode, the normal direction of the position specifying surface is preferred to be the same as the radial direction in the position specifying surface.

Here, the configurations of the center electrode, the first ground electrode, and the second ground electrode are not limited to the above-described configurations. Other various configurations can be adopted.

The present invention has been described above based on the embodiment and the modifications. The above-described embodiments of the invention are for ease of understanding of the present invention and do not limit the present invention. The present invention may be modified or improved without departing from the gist and the claims of the present invention, and includes the equivalents.

INDUSTRIAL APPLICABILITY

The present invention is preferably applicable to a spark plug that includes a center electrode, a first ground electrode that forms a first gap with a front end surface of the center electrode, and a second ground electrode that forms an annular second gap between the side surface of the center electrode and the inner peripheral surface of the second ground electrode.

DESCRIPTION OF REFERENCE SIGNS

5 Gasket
6 First rear-end-side packing
7 Second rear-end-side packing
8 Front-end-side packing
9 Talc
10 Ceramic insulator
10*s* Front end surface
11 Second outer-diameter contracted portion
12 Through hole
13 Nose portion
15 First outer-diameter contracted portion
17 Front-end-side trunk portion
18 Rear-end-side trunk portion
19 Flange portion
20 Center electrode
21 Electrode base material
22 Core material
28*s*2*e* Outer peripheral surface
28*s*1*e* Front end surface
28 Tip
28*s*1 Front end surface
28*s*2 Outer peripheral surface
30, 30*a*, and 30*b* First ground electrode
31 Front end portion
31*a* Front end portion
32 Base material
36 and 36*b* Surface layer
37 and 37*b* Core portion
38 Tip
38*s* Surface
38*se* Surface
40 Terminal metal fitting
41 Plug cap installation portion
42 Flange portion
43 Nose portion
50 Metal shell
50*b* Metal shell
50*c* Metal shell
51 Tool engagement portion

52 Screw portion
53 Crimp portion
54 Seal portion
55 Body
56 Inner-diameter contracted portion
58 Deformed portion
59 Through hole
60 Conductive seal
70 Resistor element
80 Conductive seal
90, 90*a*, 90*b*, and 90*c* Second ground electrode
91 and 91*a* Hole forming portion
92, 92*a*, 92*b*, and 92*c* Supporting portion
92*s* and 92*sa* to 92*sc* First connecting portion
92*t* and 92*ta* to 92*tc* Second connecting portion
92*s*2 End face
92*so* and 92*si* Edge
92*us* and 92*bs* Surface
96, 96*b*, and 96*c* Surface layer
97 Core portion
98 Cylindrical tip
98*s* Inner peripheral surface
98*se* Inner peripheral surface
100, 100*a*, 100*b*, and 100*c* Spark plug
501 Large internal diameter portion
501*b* and 501*c* Front end portion
501*d* Inside portion
501*e* Outside portion
501*s* and 501*sb* Front end surface
501*ds* and 501*es* Surface
501*fs* Inner peripheral surface (Partial cylindrical surface)
502 Small internal diameter portion
921 and 921*a* to 921*c* End portion
941*d* Inside portion
941*e* Outside portion
941*ds* and 941*es* Surface
941*fs* Outer peripheral surface (partial cylindrical surface)
h Shortest distance
W95, W95*b*, and W95*c* Boundary portion
g1 First gap
g2 Second gap
CL Central axis
dg1 and dg1*e* First gap size
dg2 and dg2*e* Second gap size Having described the invention, the following is claimed:

1. A spark plug, comprising:

a center electrode that extends in an axial direction;

an insulator that has an axial hole extending in the axial direction, the center electrode being to be inserted into the axial hole;

a metal shell arranged at an outer periphery of the insulator;

a first ground electrode that has electrical continuity with the metal shell, the first ground electrode forming a first gap with a front end surface of the center electrode; and a second ground electrode that has electrical continuity with the metal shell, the second ground electrode being sealed to metal shell, the second ground electrode extending from the metal shell to a position facing a side surface of the center electrode, the second ground electrode forming an annular second gap between the side surface of the center electrode and an inner peripheral surface of the second ground electrode, wherein a proportion of a size of the first gap to a size of the second gap is equal to or more than 0.80 and equal to or less than 1.25.

2. The spark plug according to claim 1, wherein the first ground electrode includes a first nickel portion that is a portion formed by nickel or a nickel alloy, the first nickel portion having a nickel content of 90 weight % or more, and the second ground electrode includes a second nickel portion that is a portion formed by nickel or a nickel alloy, the second nickel portion having a nickel content of 90 weight % or more.

3. The spark plug according to claim 1 or 2, wherein at least one of the first ground electrode and the second ground electrode includes: a surface layer that forms a surface thereof; and a core portion that is formed inside of the surface layer and has a larger thermal conductivity than a thermal conductivity of the surface layer.

4. The spark plug according to claim 3, wherein the first ground electrode is sealed to the second ground electrode.

5. The spark plug according to claim 1 or 2, wherein a shortest distance between a surface of the second ground electrode and a surface of the insulator is twice or more as large as a maximum value among the size of the first gap and the size of the second gap.

6. The spark plug according to claim 1 or 2, wherein the first ground electrode includes a first noble metal portion that is formed by a noble metal or a noble metal alloy in a position forming the first gap, the second ground electrode includes a second noble metal portion that is formed by a noble metal or a noble metal alloy in a position forming the second gap, and in the center electrode, at least a first portion and a second portion are formed by a noble metal or a noble metal alloy, the first portion forming the first gap with the first noble metal portion, the second portion forming the second gap with the second noble metal portion.

7. The spark plug according to claim 6, wherein the noble metal or the noble metal alloy is iridium or an iridium alloy.

* * * * *